US005618647A

United States Patent [19]

Kukimoto et al.

[11] Patent Number: 5,618,647

[45] Date of Patent: Apr. 8, 1997

[54] MAGNETIC TONER AND IMAGE FORMING METHOD

[75] Inventors: Tsutomu Kukimoto; Yasuhide Goseki, both of Yokohama; Motoo Urawa, Funabashi; Masayoshi Shimamura, Yokohama; Keiji Okano, Tokyo; Keita Nozawa, Yokohama; Satoshi Yoshida, Tokyo; Masaki Ojima, Inagi, all of Japan

[73] Assignee: Canon Kabushiki Kaisha, Tokyo, Japan

[21] Appl. No.: 520,558

[22] Filed: Aug. 28, 1995

[30] Foreign Application Priority Data

| | | | |
|---|---|---|---|
| Sep. 2, 1994 | [JP] | Japan | 6-232544 |
| Dec. 27, 1994 | [JP] | Japan | 6-336924 |
| Dec. 27, 1994 | [JP] | Japan | 6-337035 |
| Jun. 30, 1995 | [JP] | Japan | 7-186479 |

[51] Int. Cl.[6] ..... G03G 9/083

[52] U.S. Cl. ..... 430/106.6; 430/122

[58] Field of Search ..... 430/106.6, 122

[56] References Cited

U.S. PATENT DOCUMENTS

| | | | |
|---|---|---|---|
| 4,517,272 | 5/1985 | Jadwin et al. | 430/110 |
| 4,851,960 | 7/1989 | Nakamura et al. | 361/225 |
| 4,957,840 | 9/1990 | Sakashita et al. | 430/106.6 |
| 4,978,597 | 12/1990 | Nakahara et al. | 430/122 |
| 4,999,272 | 2/1991 | Tanikawa et al. | 430/106.6 |
| 5,009,973 | 4/1991 | Yoshida et al. | 430/45 |
| 5,137,796 | 8/1992 | Takiguchi et al. | 430/106.6 |
| 5,206,109 | 4/1993 | Anno | 430/106.6 |
| 5,310,615 | 5/1994 | Tanikawa et al. | 430/106.6 |
| 5,364,720 | 11/1994 | Nakazawa et al. | 430/106.6 |

FOREIGN PATENT DOCUMENTS

| | | | |
|---|---|---|---|
| 0395026 | 10/1990 | European Pat. Off. | G03G 9/08 |
| 0423743 | 4/1991 | European Pat. Off. | G03G 9/08 |
| 0461672 | 12/1991 | European Pat. Off. | G03G 9/08 |
| 0621513 | 10/1994 | European Pat. Off. | G03G 9/097 |
| 0677794 | 10/1995 | European Pat. Off. | G03G 15/08 |
| 57-13868 | 3/1982 | Japan | G03G 9/08 |
| 59-19704 | 2/1984 | Japan | F15B 10/47 |
| 63-149669 | 6/1988 | Japan | G03G 15/02 |
| 1-112253 | 4/1989 | Japan | G03G 9/08 |
| 1-191156 | 8/1989 | Japan | G03G 9/08 |
| 2-3073 | 1/1990 | Japan | G03G 9/08 |
| 2-123385 | 5/1990 | Japan | G03G 15/16 |
| 2-214156 | 8/1990 | Japan | H01L 27/115 |
| 2-284158 | 11/1990 | Japan | G03G 9/083 |
| 54-58245 | 2/1991 | Japan | C09K 5/00 |
| 3-63660 | 3/1991 | Japan | G03G 9/08 |
| 3-181952 | 8/1991 | Japan | G03G 9/083 |
| 4-162048 | 6/1992 | Japan | G03G 9/08 |

*Primary Examiner*—John Goodrow

*Attorney, Agent, or Firm*—Fitzpatrick, Cella, Harper & Scinto

[57] ABSTRACT

A magnetic toner has magnetic toner particles containing a binder resin and a magnetic material, and an inorganic fine powder treated with an organic compound. The magnetic toner has a volume average particle diameter $D_v$ (μm) of 3 μm$\leqq D_v$<6 μm, a weight average particle diameter $D_4$ (μm) of 3.5 μm$\leqq D_4$<6.5 μm, a percentage $M_r$ of particles with particle diameters of 5 μm or smaller in number particle size distribution of the magnetic toner, of 60% by number<$M_r\leqq$90% by number, and the ratio of a percentage $N_r$ of particles with particle diameters of 3.17 μm or smaller in number particle size distribution of the magnetic toner to a percentage $N_v$ of particles with particle diameters of 3.17 μm or smaller in volume particle size distribution of the magnetic toner, $N_r/N_v$, of from 2.0 to 8.0.

57 Claims, 5 Drawing Sheets

Xμm ISOLATED DOTS

MAGNETIC TONER AND IMAGE FORMING METHOD

BACKGROUND OF THE INVENTION

1. Field of the Invention

This invention relates to a magnetic toner used in image forming processes such as electrophotography, electrostatic recording and magnetic recording, and also relates to an image forming method employing such a magnetic toner.

2. Related Background Art

A number of methods are hitherto known for electrophotography. In general, copies are obtained by forming an electrostatic latent image on a photosensitive member by utilizing a photoconductive material and, by various means, subsequently developing the latent image by the use of a toner to form a toner image as a visible image, transferring the toner image to a transfer medium such as paper if necessary, and then fixing to the transfer medium the toner image formed thereon, by heating, pressing or heat-and-pressure means.

As methods by which the electrostatic latent image is formed into a visible image, developing methods such as cascade development, magnetic brush development and pressure development are known in the art. Another method is also known in which, using a magnetic toner and using a rotary sleeve internally provided with a magnet, the magnetic toner on the rotating sleeve is caused to fly to a photosensitive member under application of an electric field.

One-component development systems require no carrier such as glass beads, iron powder or magnetic ferrite particles required in two-component development systems, and hence can make developing assemblies themselves small-sized and light-weight. Meanwhile, since in the two-component development systems the concentration of toner in developer must be kept constant, a device for detecting toner concentration so as to supply the toner in the desired quantity is required, resulting in a more increase in size and weight of the developing assemblies. In the one-component development system, such a device is not required, and hence the developing assemblies can be made small and light-weight, as is preferable.

As printers, LED printers or LBP printers prevail in the current market. As a trend of techniques, there is a tendency toward higher resolution. Printers having a resolution of 240 or 300 dpi are being replaced by printers having a resolution of 400, 600 or 800 dpi. Accordingly, due to such a trend, the developing systems are now required to achieve a high minuteness. Copying machines have also made progress to have high functions, and hence the trend is toward digital systems. In this trend, the method chiefly employed is one in which electrostatic latent images are formed by using a laser. Hence, the copying machines also trend toward a high resolution and, as in the case of printers, it has been sought to provide a developing system with high resolution and high minuteness. Accordingly, toners are also being made to have smaller particle diameters, and toners having small particle diameters with specific particle size distributions are proposed in Japanese Patent Applications Laid-open No. 1-112253, No. 1-191156, No. 2-214156, No. 2-284158, No. 3-181952 and No. 4-162048.

In copying machines, the two-component developing system is most prevalent for medium-speed machines and high-speed machines. This is because, in the case of machines with a certain large size, stability in long-term use at high speed is more important than size or weight of the developing unit. Toners for two-component developers are commonly composed of a coloring component such as carbon black and other components almost held by polymers. Hence, toner particles are light and have no power to adhere to carrier particles, other than the electrostatic force, to tend to cause the scatter of toner especially in high-speed development, tend to cause contamination of lenses, original glass plates and transport assemblies in copying machines during long-term use, and tend to damage the stability of images. Accordingly, it is proposed to use a toner for two-component developers that is comprised of toner particles incorporated with a magnetic material so as to make the toner heavy and at the same time attractable to magnetic carrier particles by virtue not only of the electrostatic force but also the magnetic force so that the toner can be prevented from scattering.

Hence, magnetic toners containing magnetic materials have become increasingly important.

In the magnetic one-component developing system, development is carried out while the magnetic toner is formed into chains (commonly called "ears"), and hence the resolution of an image in the lateral direction tends to be poor compared with that in the longitudinal direction. For example, a phenomenon known as "smeared image trailing edge" tends to occur, which is due to the protrusion of ears into a non-image area of the latter half of a developed image, and also coarse images tend to occur compared with the two-component developing system. Accordingly, as a method for improving image reproducibility, it can be considered effective to make the ears of the magnetic toner shorter and denser. As a means therefor, it can be contemplated to decrease the proportion of the amount of a magnetic material in the magnetic toner, or to use a method in which a toner layer thickness control member is firmly brought into touch with the toner carrying member. However, an attempt to decrease the proportion of the amount of a magnetic material in the magnetic toner commonly results in an excessive increase in charge quantity of the magnetic toner to tend to cause the phenomenon of charge-up and cause a decrease in image density and an increase in fog, bringing about a lowering of image quality level.

The relationship between the intensity of magnetization of magnetic toners and the shape of each ear is understood as follows: When the intensity of magnetization of a magnetic toner is great, a strong attraction force in the direction of the magnetic field and a strong repulsion force in the direction perpendicular to the magnetic field act between magnetic toner particles. Hence, when the intensity of magnetization is great, the ears formed by the magnetic toner become long, the ears formed on the toner carrying member become loose and each ear becomes slender. Inversely, when the intensity of magnetization of a magnetic toner is small, the ears become short and the ears formed on the toner carrying member become dense, but each ear becomes thick and short because of no loosening of the combination between magnetic toner particles, resulting in an aggregated state. Hence, in the latter case, the magnetic toner particles present inside the ears have less opportunities to contact with the surface of the toner carrying member to tend to be insufficiently statically charged. Such magnetic toner particles insufficiently charged tend to cause fog on images, resulting in a lowering of image quality level.

In recent years, from the viewpoint of environmental protection, the primary charging process utilizing corona discharge and the transfer process utilizing corona discharge, which have been conventionally used, are making way for the primary charging process and/or transfer process making use of a contact member on the photosensitive member, which is/are becoming prevalent. For example, processes concerning contact charging or contact transfer are proposed in Japanese Patent Applications Laid-open No. 63-149669 and No. 2-123385. A conductive flexible charging roller is brought into contact with an electrostatic latent image bearing member and the electrostatic latent image bearing member is statically charged while applying a voltage to the conductive flexible charging roller, followed by exposure to form an electrostatic latent image. The electrostatic latent image is developed to form a toner image. Thereafter a conductive transfer roller to which a voltage has been applied is pressed against the electrostatic latent image bearing member, during which a transfer medium is passed between them, and the toner image held on the electrostatic latent image bearing member is transferred to the transfer medium, followed by the step of fixing to obtain a fixed image.

Since, however, in such a contact transfer system utilizing no corona discharge, the transfer means presses the transfer medium against the electrostatic latent image bearing member at the time of transfer, the toner image undergoes pressure when the toner image formed on the electrostatic latent image bearing member is transferred to the transfer medium, tending to cause a problem of partial faulty transfer, i.e., what is called "blank areas caused by poor transfer".

Moreover, in the contact transfer system, the electrical discharge produced between the charging roller and the electrostatic latent image bearing member more greatly physically and chemically acts on the surface of the electrostatic latent image bearing member than in the corona charging system. In particular, in the combination of an OPC photosensitive member with blade cleaning, problems such as melt adhesion of toner onto the OPC photosensitive member and faulty cleaning tends to occur, which are caused by a deterioration of the OPC photosensitive member surface. Combination of direct charging/organic photosensitive member/magnetic one-component developing system, contact transfer/blade cleaning can make image forming apparatus low-cost, small-sized and light-weight with ease, and is a system preferable for copying machines, printers and facsimile machines used in the field where the low cost, small size and light weight are demanded.

Accordingly, magnetic toners used in such an image forming method are required to have good releasability and lubricity. Incorporation of a silicone compound into a toner is proposed in Japanese Patent Publication No. 57-13868, Japanese Patent Applications Laid-open No. 54-58245, No. 59-197048, No. 2-3073 and No. 3-63660 and U.S. Pat. No. 4,517,272. Since, however, in such a method the silicone compound is directly added in toner particles, the silicone compound, having no compatibility with binder resins, has so poor a dispersibility in toner particles that the charging performance of the toner particles tends to be non-uniform to cause the problem of a lowering of developing performance in long-term repeated use.

In recent years, from the viewpoint of environment protection, reclaimed paper has come to be used as copy paper. Since, however, the reclaimed paper may produce paper dust and filler powder in a large quantity when used, the problems of faulty cleaning and melt adhesion of toner tend to occur. These problems must be overcome in order to accomplish image forming apparatus that are small-sized, light-weight and low-cost and which can obtain images with a high resolution and a high minuteness while taking into account environmental problems.

SUMMARY OF THE INVENTION

An object of the present invention is to provide a magnetic toner and an image forming method that have solved the above problems involved in the prior art.

Another object of the present invention is to provide magnetic toner that can obtain images faithful to electrostatic latent images, substantially free from fog and smeared image trailing edge caused by toner, and having a high resolution and a high minuteness reproducibility, and an image forming method making use of the magnetic toner.

Still another object of the present invention is to provide a magnetic toner that can provide excellent transfer performance and which causes no blank areas caused by poor transfer also in the contact transfer system, or at least causes a lessening of such a phenomenon, and an image forming method making use of the magnetic toner.

A further object of the present invention is to provide a magnetic toner that has a superior releasability and lubricity, can maintain such a function even after printing for a long period time and on a large number of sheets and which causes neither toner melt adhesion nor faulty cleaning, or at least causes a lessening of these phenomena, and an image forming method making use of the magnetic toner.

A still further object of the present invention is to provide a magnetic toner that causes neither abnormal charging nor faulty images due to contamination of electrostatic latent image bearing members, or at least causes a lessening of these phenomena, and an image forming method making use of the magnetic toner.

To achieve the above objects, the present invention provides a magnetic toner comprising magnetic toner particles containing a binder resin and a magnetic material, and an inorganic fine powder treated with an organic compound, wherein;

the magnetic toner has;

a volume average particle diameter $D_v$ (μm) of 3 μm$\leqq D_v$<6 μm;

a weight average particle diameter $D_4$ (μm) of 3.5 μm$\leqq D_4$<6.5 μm;

a percentage $M_r$ of particles with particle diameters of 5 μm or smaller in number particle size distribution of the magnetic toner, of 60% by number<$M_r\leqq$90% by number; and the ratio of a percentage $N_r$ of particles with particle diameters of 3.17 μm or smaller in number particle size distribution of the magnetic toner to a percentage $N_v$ of particles with particle diameters of 3.17 μm or smaller in volume particle size distribution of the magnetic toner, $N_r/N_v$, of from 2.0 to 8.0.

The present invention also provides an image forming method comprising;

electrostatically charging an electrostatic latent image bearing member through a charging means;

exposing the charged electrostatic latent image bearing member to light to forming an electrostatic latent image on the electrostatic latent image bearing member;

developing the electrostatic latent image through a developing means having a magnetic toner, to form a magnetic toner image on the electrostatic latent image bearing member;

transferring the magnetic toner image to a transfer medium via, or not via, an intermediate transfer medium through a transfer means to which a bias voltage is applied;

wherein the magnetic toner comprises magnetic toner particles containing a binder resin and a magnetic material, and an inorganic fine powder treated with an organic compound, wherein;

the magnetic toner has;

a volume average particle diameter $D_v$ (μm) of 3 μm≦$D_v$<6 μm;

a weight average particle diameter $D_4$ (μm) of 3.5 μm≦$D_4$<6.5 μm;

a percentage $M_r$ of particles with particle diameters of 5 μm or smaller in number particle size distribution of the magnetic toner, of 60% by number<$M_r$≦90% by number; and the ratio of a percentage $N_r$ of particles with particle diameters of 3.17 μm or smaller in number particle size distribution of the magnetic toner to a percentage $N_v$ of particles with particle diameters of 3.17 μm or smaller in volume particle size distribution of the magnetic toner, $N_r/N_v$, of from 2.0 to 8.0.

DESCRIPTION OF THE PREFERRED EMBODIMENTS

Figure 1:
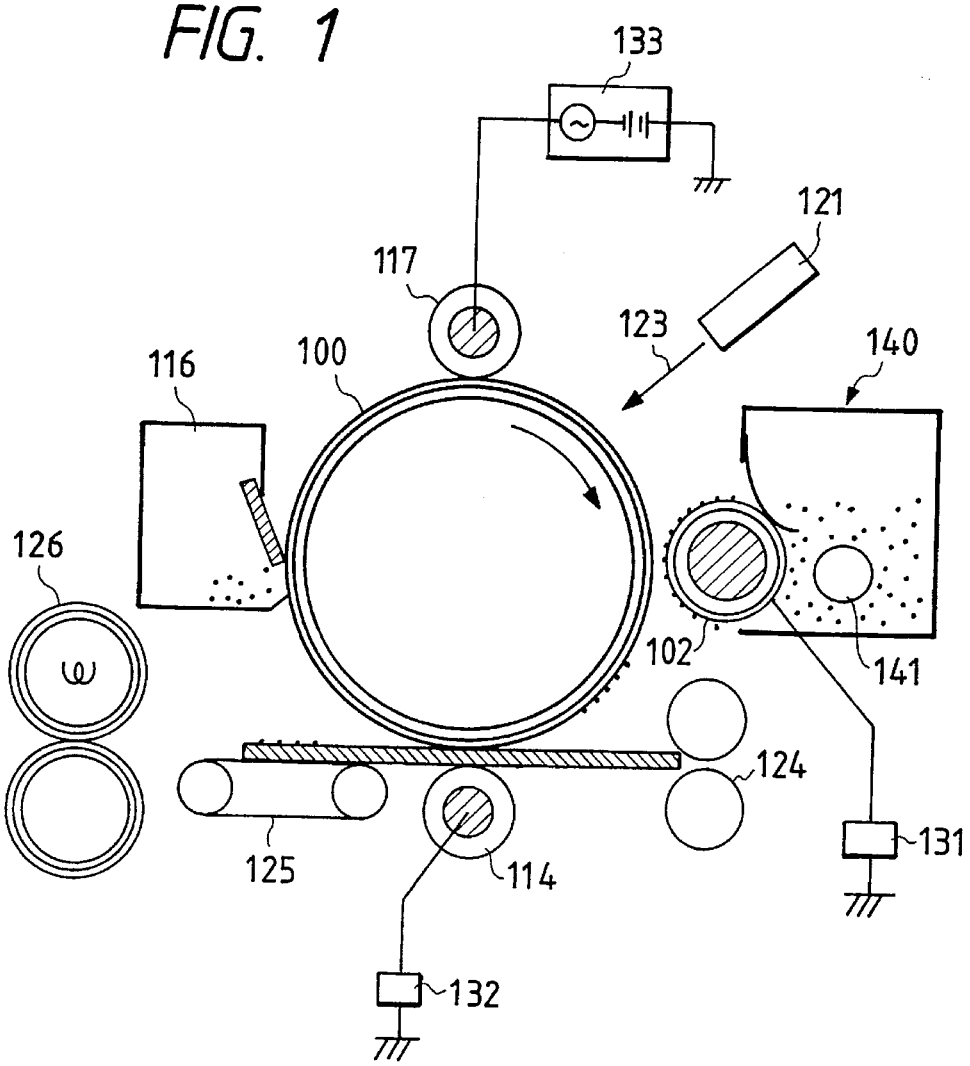
FIG. 1 is a schematic illustration of an image forming apparatus that can carry out the image forming method of the present invention.

The magnetic toner of the present invention has;

a volume average particle diameter $D_v$ (μm) of 3 μm≦$D_v$<6 μm;

a weight average particle diameter $D_4$ (μm) of 3.5 μm≦$D_4$<6.5 μm;

a percentage $M_r$ of particles with particle diameters of 5 μm or smaller in number particle size distribution of the magnetic toner, of 60% by number<$M_r$≦90% by number; and the ratio of a percentage $N_r$ of particles with particle diameters of 3.17 μm or smaller in number particle size distribution of the magnetic toner to a percentage $N_v$ of particles with particle diameters of 3.17 μm or smaller in volume particle size distribution of the magnetic toner, $N_r/N_v$, of from 2.0 to 8.0.

If the particles with particle diameters of 5 μm or smaller is not more than 60% by number, the magnetic toner can be less effective for decreasing toner consumption. If the volume average particle diameter $D_v$ (μm) is 6 μm or larger and the weight average particle diameter $D_4$ (μm) is 6.5 μm or larger, the resolution of isolated dots of about 50 μm may lower. Here, if images are forcibly ressolved under conditions of development, thickened line images or black spots around line images tend to occur and also the consumption of the magnetic toner tends to increase. When the magnetic toner has the particle size distributions defined above, a high productivity can be maintained also when toners with fine particle diameters are produced. If the magnetic toner particles with particle diameters of 5 μm or smaller are more than 90% by number, the image density may decrease. Such particles may preferably be in a percentage of 62% by number≦$M_r$≦88% by number. With regard to the average particle diameters, those of 3.2 μm≦$D_v$≦5.8 μm and 3.6 μm≦$D_4$≦6.3 μm are preferred in order to more improve resolution.

The ratio of a percentage $N_r$ of particles with particle diameters of 3.17 μm or smaller in number particle size distribution of the magnetic toner to a percentage $N_v$ of particles with particle diameters of 3.17 μm or smaller in volume particle size distribution of the magnetic toner, $N_r/N_v$, is from 2.0 to 8.0. This is preferable from the viewpoint of image quality. It the ratio is less than 2.0, fog tends to occur, and if it is more than 8.0, the resolution of isolated dots of about 50 μm tends to lower. The $N_r/N_v$ may more preferably be from 3.0 to 7.0. The percentage $N_r$ of particles with particle diameters of 3.17 μm or smaller in number particle size distribution may be from 5 to 40% by number, and preferably from 7 to 35% by number.

With regard to coefficient of variation in the particle size distribution of the magnetic toner, a coefficient of variation B in the number particle size distribution may preferably be 20≦B<40.

B represents $S_v/D_1$, where $D_1$ represents a number average particle diameter of the magnetic toner, and $S_v$ represents a standard deviation of number average particle diameter of the magnetic toner.

The magnetic toner may preferably have an absolute value (mC/g) of quantity of triboelectricity with respect to iron powder, of 14≦Q≦80, more preferably 14≦Q≦60, and particularly preferably 24<Q≦55. If Q<14, the magnetic toner may have a low triboelectric charging performance and can be less effective for decreasing toner consumption. If 80<Q, the magnetic toner may have so high a triboelectric charging performance to tends to cause a decrease in image density.

Magnetic toner particles with particle diameters of 8 μm or larger in volume particle size distribution of the magnetic toner may preferably be in a volume percentage of 10% by volume or less, from the viewpoint of decreasing the scatter of the magnetic toner, preventing change of particle size distribution of the magnetic toner throughout running on a large number of sheets, and obtaining stable image density.

The magnetic toner of the present invention is made to have small particle diameters so that a higher image quality can be achieved, and contains the magnetic toner particles with particle diameters of 5 μm or smaller, attributable to a large quantity of triboelectricity per unit weight, in a large proportion so that a low consumption of the magnetic toner can be achieved.

In general, with regard to toner consumption of the magnetic toner, magnetic toners participate more in development at line image areas than at solid image portions. The reason for this is presumed to be as follows: In electrostatic latent images at line image areas on an electrostatic latent image bearing member, as opposed to solid image areas, the lines of electric force densely go around from the outside of a linear electrostatic latent image to the inside of the linear electrostatic latent image and hence the electrostatic force to attract the magnetic toner to, and press it on, the inside of the electrostatic latent image is greater at the line image areas, so that a large quantity of the magnetic toner tends to be laid on the linear electrostatic latent image face.

Since the magnetic toner used in the present invention contains a larger quantity of particles with particle diameters of 5 μm or smaller, attributable to a large quantity of triboelectricity, it is presumed that the magnetic toner can fill up the latent image potential with ease, and more particles than are necessary among the magnetic toner having participated in development at the line image areas on the electrostatic latent image bearing member can return to the surface of the developing sleeve against the force of the electric lines going around toward the latent image, so that only a proper quantity of magnetic toner remains on the line image areas. Since the magnetic toner particles with particle diameters of 5 μm or smaller are attributable to a large quantity of triboelectricity per unit weight, they reach the latent image on the electrostatic latent image bearing member faster than magnetic toner particles having larger particle diameters to weaken the developing electric field, and hence other magnetic toner particles are affected with difficulty by the electric lines going around toward the latent image.

The magnetic material contained in the magnetic toner particles may preferably be a magnetic material formed of a metal oxide having a magnetization intensity (σs) greater than 50 $Am^2/kg$ (emu/g) under application of a magnetic field of 79.6 kA/m (1,000 oersteds), as exemplified by a metal oxide containing an element such as ion, cobalt, nickel, copper, magnesium, manganese, aluminum or silicon. Such a magnetic material may have a BET specific surface area, as measured by nitrogen gas absorption, of from 1 to 30 $m^2/g$, and particularly from 2.5 to 26 $m^2/g$.

The magnetic material may preferably be in a content of from 50 to 200 parts by weight, and particularly from 60 to 150 parts by weight, based on 100 parts by weight of the binder resin. It it is in a content less than 50 parts by weight, the transport performance of the magnetic toner may lower to tend to make the toner layer on the toner carrying member uneven and cause uneven images in some cases, and also the quantity of triboelectricity of the magnetic toner may increase to tend to cause a decrease in image density. On the other hand, if it is in a content more than 200 parts by weight, the fixing performance of the magnetic toner tends to come into question.

The magnetic material may preferably have a number average particle diameter of from 0.05 to 1.0 μm, more preferably from 0.1 to 0.6 μm, and still more preferably from 0.1 to 0.4 μm. The magnetic material may preferably have a Mohs hardness of from 5 to 7.

The magnetic material may preferably have a sphericity $\phi$ of 0.8 or more and have a silicon element content of from 0.5% by weight to 4% by weight based on iron element.

As the binder resin used in the present invention, it may include polystyrene; homopolymers of styrene derivatives such as poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. A cross-linked styrene resin is a preferred binder resin.

Comonomers copolymerizable with styrene monomers in the styrene copolymers may include monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof such as maleic acid, butyl maleate, methyl maleate and dimethyl maleate; vinyl esters such as vinyl chloride, vinyl acetate and vinyl benzoate; olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination, and are used upon synthesis with styrene monomers. As cross-linking agents, compounds having at least two polymerizable double bonds may be used. For example, they include aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

In bulk polymerization, low-molecular weight polymers can be obtained by carrying out the polymerization at a high temperature and accelerating the rate of termination reaction. There, however, the problem of a difficulty in reaction control. In solution polymerization, low-molecular weight polymers can be readily obtained under mild conditions by utilizing a difference in chain transfer of radicals which is ascribable to solvents, and controlling the amount of polymerization initiators and the reaction temperature. Hence, the latter is preferred when a low-molecular weight polymer is obtained which is contained in the binder resin used in the present invention.

As solvents used in the solution polymerization, xylene, toluene, cumene, cellosolve acetate, isopropyl alcohol, benzene or the like may be used. When a mixture of styrene monomer with other vinyl monomer is used, xylene, toluene or cumene is preferred.

As a binder resin for the magnetic toner, when used in pressure fixing, it may include low-molecular weight polyethylene, low-molecular weight polypropylene, an ethylene-vinyl acetate copolymer, an ethylene-acrylate copolymer, higher fatty acids, polyamide resins and polyester resins. These may preferably be used either alone or in combination.

For the purposes of improving releasability from fixing members such as rollers or films at the time of fixing and improving fixing performance, it is preferable to incorporate any of the following waxes in the magnetic toner. They may include paraffin wax and derivatives thereof, microcrystalline wax and derivatives thereof, Fischer-Tropsch wax and derivatives thereof, polyolefin wax and derivatives thereof, and carnauba wax and derivatives thereof. The derivatives are meant to be oxides, block copolymers with vinyl monomers, and graft modified products.

Besides, the waxes may further include alcohols, fatty acids, acid amides, esters, ketones, hardened caster oil and derivatives thereof, vegetable waxes, animal waxes, mineral waxes and petrolatum, any of which may be incorporated in the magnetic toner particles.

As colorants used in the magnetic toner, conventionally known inorganic or organic dyes and pigments may be used, as exemplified by, carbon black, aniline black, acetylene black, Naphthol Yellow, Hanza Yellow, Rhodamine Lake, Alizarine Lake, red iron oxide, Phthalocyanine Blue and Indanethrene Blue. Usually, any of these may be used in an amount of from 0.5 part to 20 parts by weight based on 100 parts by weight of the binder resin.

In the magnetic toner of the present invention, a charge control agent may preferably be used by compounding it into magnetic toner particles (internal addition) or blending it with magnetic toner particles (external addition). The charge control agent enables control of optimum charge quantity in conformity with developing systems. Particularly in the present invention, it can make more stable the balance between particle size distribution and charge quantity. As those capable of controlling the magnetic toner to be negatively chargeable, organic metal complexes or chelate compounds are effective. For example, they include monoazo metal complexes, acetylacetone metal complexes, and metal complexes of an aromatic hydroxycarboxylic acid type or aromatic dicarboxylic acid type. Besides, they include aromatic mono- or polycarboxylic acids and metal salts, anhydrides or esters thereof, and phenol derivatives such as bisphenol.

Those capable of controlling the magnetic toner to be positively chargeable include the following materials.

Nigrosine and products modified with a fatty acid metal salt; quaternary ammonium salts such as tributylbenzylammonium 1-hydroxy-4-naphthosulfonate and tetrabutylammonium teterafluoroborate, and analogues of these, including onium salts such as phosphonium salts and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more kinds.

The charge control agents described above may preferably be used in the form of fine particles. These charge control agents may preferably have a number average particle diameter of 4 μm or smaller, and particularly preferably 3 μm or smaller. In the case when the charge control agent is internally added to the magnetic toner particles, it may preferably be used in an amount of from 0.1 to 20 parts by weight, and particularly from 0.2 to 10 parts by weight, based on 100 parts by weight of the binder resin.

In order to improve environmental stability, charging stability, developing performance, fluidity and storage stability, the magnetic toner of the present invention is prepared by mixing the magnetic toner particles with an inorganic fine powder treated with an organic compound, which may be mixed by agitation using a mixer such as a Henschel mixer.

The inorganic fine powder used in the present invention may include, for example, the following, which includes colloidal silica, titanium oxide, iron oxide, aluminum oxide, magnesium oxide, calcium titanate, barium titanate, strontium titanate, magnesium titanate, cerium oxide and zirconium oxide. Any of these may be used by mixture of other one or two or more kinds of these. Oxides such as titania, alumina and silica or double oxides thereof are preferred.

Fine silica powder is particularly preferred. For example, the fine silica powder includes what is called dry-process silica or fumed silica produced by vapor phase oxidation of silicon halides and what is called wet-process silica produced from water glass or the like, either of which can be used. The dry-process silica is preferred, as having less silanol groups on the surface and inside and leaving no production residue such as $Na_2O$ and $SO_3^{2-}$. In the dry-process silica, it is also possible to use, in its production step, other metal halide such as aluminum chloride or titanium chloride together with the silicon halide to give a composite fine powder of silica with other metal oxide. The fine silica powder of the present invention includes these, too.

In the present invention, it is a feature of the invention to use the inorganic fine powder treated with an organic compound. As methods for the treatment with an organic compound, the inorganic fine powder may be treated with an organic metal compound such as a silane coupling agent or titanium coupling agent, capable of reacting with or physically adhering to the inorganic fine powder, or it may be treated with a silane coupling agent and thereafter, or simultaneously therewith, treated with an organosilicon compound such as silicone oil. The silane coupling agent used in the treatment may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethyldiethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals.

It may also include silane coupling agents having a nitrogen atom, such as aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine and trimethoxysilyl-γ-propylbenzylamine, which may be used alone or in combination. As a preferred silane coupling agent, it may include hexamethyldisilazane (HMDS). As a preferred organosilicon compound, it may include silicone oils. As the silicone oils, those having a viscosity at 25° C., of from 0.5 to 10,000 centistokes, and preferably from 1 to 1,000 centistokes, may be used. For example, dimethylsilicone oil, methylphenylsilicone oil, α-methylstyrene-modified silicone oil, chlorophenylsilicone oil and fluorine-modified silicone oil are particularly preferred. As methods for the treatment with silicone oil, for example, the fine silica powder treated with a silane coupling agent may be directly mixed with the silicone oil by means of a mixer such as a Henschel mixer, or the fine silica powder, serving as a base, may be sprayed with the silicone oil. Alternatively, the silicone oil may be dissolved or dispersed in a suitable solvent and thereafter the fine silica powder may be added, followed by mixing and then removal of the solvent.

The inorganic fine powder treated with the organic compound, used in the present invention, may preferably have a BET specific surface area, as measured by the BET method using nitrogen gas absorption, of 30 $m^2/g$ or more, and particularly in the range of from 50 to 400 $m^2/g$.

The inorganic fine powder treated with the organic compound, used in the present invention, may preferably be used in an amount of from 0.01 to 8 parts by weight, preferably from 0.1 to 5 parts by weight, and particularly preferably from 0.2 to 3 parts by weight, based on 100 parts by weight of the magnetic toner particles. Its use in an amount less than 0.01 part by weight can be less effective for preventing the magnetic toner from agglomerating, and its used in an amount more than 8 parts by weight tends to cause the problems of toner scatter causing black spots around fine-line images, in-machine contamination, and scratches or wear of photosensitive members.

In the magnetic toner of the present invention, other additives may also be used so long as they substantially do not adversely affect the toner, which may include, for example, lubricant powders such as Teflon powder, stearic acid zinc powder and vinylidene polyfluoride powder; abrasives such as cerium oxide powder, silicon carbide powder and strontium titanate powder; fluidity-providing agents such as titanium oxide powder and aluminum oxide powder; anti-caking agents; and conductivity-providing agents such as carbon black powder, zinc oxide powder and tin oxide powder. Reverse-polarity organic particles and inorganic particle may also be used in a small quantity as a developability improver.

In the magnetic toner of the present invention, it is preferable to make a liquid lubricant present inside the magnetic toner particles and/or outside the magnetic toner particles.

In the case when the liquid lubricant is made present inside the magnetic toner particles, the liquid lubricant may preferably be supported on supporting particles such as the above magnetic material by adsorption, granulation, agglomeration, impregnation, encapsulation or the like means so as to be incorporated into the magnetic toner particles. This enables the liquid lubricant to be present on the magnetic toner particle surfaces uniformly and in a proper quantity, so that the releasability and lubricity of the magnetic toner particles can be made stable.

As the liquid lubricant for imparting the releasability and lubricity to the magnetic toner, animal oil, vegetable oil, petroleum oil or synthetic lubricating oil may be used. Synthetic lubricating oil is preferably used in view of its stability. The synthetic lubricating oil may include silicone oils such as dimethylsilicone oil, methylphenylsilicone oil, modified silicone oil of various types; polyol esters such as pentaerythritol ester and trimethylolpropane ester; polyolefins such as polyethylene, polypropylene, polybutene and poly(α-olefin); polyglycols such as polyethylene glycol and polypropylene glycol; silicic esters such as tetradecyl silicate and tetraoctyl silicate; diesters such as di-2-ethylhexyl sebacate and di-2-ethylhexyl adipate; phosphoric esters such as tricresyl phosphate and propylphenyl phosphate; fluorinated hydrocarbon compounds such as polychlorotrifluoroethylene, polytetrafluoroethylene, polyvinylidene fluoride and polyethylene fluoride; polyphenyl ethers, alkylnaphthenes, and alkyl aromatics. In particular, from the viewpoint of thermal stability and oxidation stability, silicone oils and fluorinated hydrocarbons are preferred. The silicone oils include amino-modified, epoxy-modified, carboxyl-modified, carbinol-modified, methacryl-modified, mercapto-modified, phenol-modified or heterofunctional group-modified reactive silicone oils; polyether-modified, methylstyryl-modified, alkyl-modified, fatty acid-modified, alkoxy-modified or fluorine-modified non-reactive silicone oils; and straight silicone oils such as dimethylsilicone oil, methylphenylsilicone oil and methylhydrogensilicone oil; any of which may be used.

In the present invention, the liquid lubricant supported on the particle surfaces of the magnetic material, or on other supporting particles, is partly liberated to become present on the surfaces of the magnetic toner particles and thereby exhibits its efficacy. Hence, curable silicone oils are less effective on account of their nature. Reactive silicone oils or silicone oils having polar groups may be strongly adsorbed on the supporting medium of the liquid lubricant or may become compatible with the binder resin, so that they may be liberated in a small quantity depending on the degree of adsorption or compatibility, and can not be so effective in some cases. Non-reactive silicone oils may also become compatible with the binder resin, depending on the structure of the side chain, and can be less effective in some cases. Hence, dimethylsilicone oil, fluorine-modified silicone oils, fluorinated hydrocarbons or the lie are preferably used because of less polarity, no strong adsorption and no compatibility with binder resins. The liquid lubricant used in the present invention may preferably have a viscosity at 25° C. of from 10 to 200,000 cSt, more preferably from 20 to 100,000 cSt, and still more preferably from 50 to 70,000 cSt. If it has a viscosity lower than 10 cSt, low-molecular weight components increase to tend to cause problems in developing performance and storage stability. If it has a viscosity higher than 200,000 cSt, its movement through or dispersion in the magnetic toner particles may be non-uniform to tend to cause problems in developing performance, transport performance, anti-contamination properties and so forth. In the present invention, the viscosity of the liquid lubricant is measured using, for example, Viscotester VT500 (manufactured by Haake Co.).

One of sensors of some viscosity sensors for VT500 is arbitrarily selected, and a specimen to be measured is put in a cell for the sensor to make measurement. Viscosities (pas) indicated on the device are calculated into cSt.

In the present invention, the liquid lubricant is used in such a way that it is supported on the magnetic material, and/or supported on other supporting particles to form lubricating particles which will be described later, and hence can achieve better dispersibility than a case when the liquid lubricant such as silicone oil is merely added as it is. In the present invention, however, it is not intended to merely improve dispersibility. The liquid lubricant must be liberated from the supporting particles so that the releasability and lubricity attributable thereto can be exhibited, and at the same time the liquid lubricant must be made to have an appropriate adsorption strength so that it can be prevented from being liberated in excess.

The liquid lubricant is held on the surfaces of supporting particles so as to be made present on the surfaces of toner particles or in the vicinity thereof, whereby the quantity of the liquid lubricant on the surfaces of the magnetic toner particles can be appropriately controlled.

As a specific method for making the liquid lubricant of the present invention supported on the particle surfaces of the magnetic material, a wheel type kneading machine or the like may be used. When the wheel type kneading machine or the like is used, the liquid lubricant present between magnetic particles is, by virtue of compression action, pressed against magnetic particle surfaces and at the same time passed through gaps between the magnetic particles to widen the gaps by force to increase its adhesion to the magnetic particle surfaces. While the liquid lubricant is extended by virtue of shear action, the shear force acts on the magnetic particles at different positions to loosen their agglomeration. Moreover, by virtue of pressing action, the liquid lubricant present on the magnetic particle surfaces is uniformly spread. These three actions are repeated to completely loosen the agglomeration between magnetic particles, so that the liquid lubricant is uniformly supported on the surfaces of individual magnetic particles in such a state that the individual magnetic particles are kept apart one by one. Thus, this is a particularly preferred means. As the wheel type kneading machine, it is preferable to use a Simpson mix muller, a multi-muller, a Stotz mill, an Eirich mill or a reverse-flow kneader.

It is also known to use a method in which the liquid lubricant is, as it is or after diluted with a solvent, directly mixed with magnetic particles so as to be supported thereon, by means of a mixing machine such as a Henschel mixer or a ball mill, or a method in which the liquid lubricant is directly sprayed on magnetic particles so as to be supported thereon. According to these methods, however, in the case of magnetic particles, it is difficult to make a small quantity of liquid lubricant uniformly supported on the supporting particles, or shear force and heat are locally applied to cause the liquid lubricant to be firmly adsorbed on the particles. Moreover, in the case of silicone oils, the liquid lubricant may seize (or burn to stick) on the supporting particles and hence can not be effectively liberated therefrom in some cases.

As to the amount of the liquid lubricant supported on the magnetic material, the amount of the liquid lubricant with respect to the binder resin is important from the viewpoint of its efficacy. As its optimum range, the liquid lubricant may preferably be added and made supported on the magnetic material so as to be in an amount of from 0.1 to 7 parts by weight, more preferably from 0.2 to 5 parts by weight, and particularly from 0.3 to 2 parts by weight, based on 100 parts by weight of the binder resin.

As supporting particles other than the magnetic material described above, used to form lubricating particles with the liquid lubricant supported thereon, fine particles of an organic compound or inorganic compound which are prepared by granulation or agglomeration using the liquid lubricant are used as supporting particles for the lubricating particles.

The organic compound may include resins such as styrene resin, acrylic resin, silicone resin, polyester resin, urethane resin, polyamide resin, polyethylene resin or fluorine resin. The inorganic compound may include oxides such as $SiO_2$, $GeO_2$, $TiO_2$, $SnO_2$, $Al_2O_3$, $B_2O_3$ and $P_2O_5$; metal oxide salts such as silicate, borate, phosphate, borosilicate, aluminosilicate, aluminoborate, aluminoborosilicate, tungstate, molybdate and tellurate; composite compounds of any of these; silicon carbide, silicon nitride, and amorphous carbon. These may be used alone or in the form of a mixture.

As the fine particles of the inorganic compound, fine inorganic compound particles produced by the dry process and those produced by the wet process may be used. The dry process herein referred to is a process for producing fine inorganic compound particles formed by vapor phase oxidation of a halogen compound. For example, it is a process that utilizes heat decomposition oxidation reaction in the oxyhydrogen of halide gas. The reaction basically proceeds as shown by the following scheme.

$$MX_n+1/2nH_2+1/4O_2 \rightarrow MO_2+nHCl$$

In this reaction scheme, M represents a metal or semimetal element, X represents a halogen element, and n represents an integer. Stated specifically, when $AlCl_3$, $TiCl_4$, $GeCl_4$, $SiCl_4$, $POCl_3$ or $BBr_3$ is used, $Al_2O_3$, $TiO_2$, $GeO_2$, $SiO_2$, $P_2O_5$ or $B_2O_3$, respectively, are obtained. Here, composite compounds are obtained when halides are used by mixture.

Besides, dry-process fine particles can be obtained by applying a production process such as thermal CVD or plasma-assisted CVD. In particular, $SiO_2$, $Al_2O_3$, $TiO_2$ and so forth may preferably be used.

Meanwhile, as methods by which the inorganic compound fine particles used in the present invention is produced by the wet process, conventionally known various methods can be used. For example, there is a method in which sodium silicate is decomposed using an acid, as shown by the reaction scheme below.

$$Na_2O.XSiO_2+HCl+H_2O \rightarrow SiO_2.nH_2O+NaCl$$

There is also a method in which sodium silicate is decomposed using an ammonium salt or alkali salt, a method in which an alkaline earth metal silicate is produced from sodium silicate followed by decomposition using an acid to give silicic acid, a method in which an aqueous sodium silicate solution is passed through an ion-exchange resin to give silicic acid, and a method making use of naturally occurring silicic acid or silicate. Besides, there is a method in which a metal alkoxide is hydrolyzed. The general reaction scheme is shown below.

$$M(OR)_nO+1/2nH_2O \rightarrow MO_2+ROH$$

In this reaction scheme, M represents a metal or semimetal element, R represents an alkyl group, and n represents an integer. Here, composite compounds are obtained when two or more metal alkoxides are used.

Of these, fine particles of the inorganic compound are preferable in view of their appropriate electrical resistance. In particular, fine particles of an oxide of Si, Al or Ti or a double oxide of any of these are preferred.

Fine particles whose surfaces have been made hydrophobic by a coupling agent may also be used. However, some liquid lubricants tend to cause excessive charging when the surfaces of the magnetic toner particles are coated. Use of those having not been made hydrophobic enables the charges to be appropriately leaked to make it possible to maintain good developing performance. Hence, it is one of preferred embodiments to use supporting particles having not been subjected to hydrophobic treatment.

The supporting particles may preferably have a particle diameter of from 0.001 to 20 μm, and particularly from 0.005 to 10 μm. The fine particles may preferably have a BET specific surface area, as measured by the BET method using nitrogen gas absorption, of from 5 to 500 $m^2/g$, more preferably from 10 to 400 $m^2/g$, and still more preferably from 20 to 350 $m^2/g$. If the particles have a BET specific surface area smaller than 5 $m^2/g$, it is difficult for the liquid lubricant of the present invention to be held in the integral form of lubricating particles having preferable particle diameters.

The liquid lubricant in the lubricating particles may be in an amount of from 20 to 90% by weight, preferably from 27 to 87% by weight, and particularly preferably from 40 to 80% by weight. If the liquid lubricant is in an amount less than 20% by weight, no satisfactory releasability and lubricity can be imparted to the magnetic toner particles, and if, for that reason, the lubricating particles are added in a large quantity, the developing performance tends to be unstable. If it is in an amount more than 90% by weight, it is difficult to obtain lubricating particles uniformly containing the liquid lubricant.

A method has been hitherto proposed in which silicone oil is adsorbed on $SiO_2$, $Al_2O_3$ or TiO. Such a method, however, achieves so strong an adsorption that it is difficult for the liquid lubricant to come to the surfaces of the magnetic toner particles to make it difficult to impart good lubricity and releasability to the magnetic toner particles. In order to enable liberation of the liquid lubricant while holding it, the lubricating particles may preferably have a particle diameter of 0.5 μm or larger, and more preferably 1 μm or larger, and also the main component thereof according to volume-based distribution may preferably have a larger particle diameter than the magnetic toner particles.

These lubricating particles hold the liquid lubricant in so large a quantity and are so brittle that they collapse in part during the production of the magnetic toner and are uniformly dispersed in the magnetic toner particles and at the same time can liberate the liquid lubricant to impart the lubricity and releasability to the magnetic toner particles. On the other hand, the remaining lubricating particles are present in the magnetic toner particles in such a state that they maintain the ability to hold the liquid lubricant.

Hence, the liquid lubricant is by no means moved in excess to the surfaces of the magnetic toner particles and also the magnetic toner may hardly cause a lowering of fluidity and developing performance. Meanwhile, even if the liquid lubricant has gone away in part from the surfaces of the magnetic toner particles, it can be supplemented from the lubricating particles, and hence it is possible to maintain the releasability and lubricity of the magnetic toner particles for a long period of time. These lubricating particles can be produced by granulation according to a method in which liquid droplets of the liquid lubricant or of a solution prepared by diluting it in a desired solvent are adsorbed on the supporting particles. The solvent is evaporated after the granulation, and the product may further be pulverized if necessary. Alternatively, a method may also be used in which the liquid lubricant or a dilute solution thereof is added to the supporting particles and the mixture obtained is kneaded, optionally followed by pulverization to carry out granulation, and thereafter the solvent is evaporated. The lubricating particles may preferably be contained in an amount of from 0.01 to 50 parts by weight, more preferably from 0.05 to 50 parts by weight, and particularly preferably from 0.1 to 20 parts by weight, based on 100 parts by weight of the binder resin. If it is in an amount less than 0.01 part by weight, good lubricity and releasability can be obtained with difficulty. If it is in an amount more than 50 parts by weight, charging stability and productivity may lower.

As the lubricating particles, those comprising a porous powder impregnated with or internally holding the liquid lubricant may also be used.

The porous powder includes molecular sieves as typified by zeolite, and clay minerals such as bentonite, as well as aluminum oxide, titanium oxide, zinc oxide, resin gels and so forth. Of these porous powders, powders such as resin gels whose particles collapse with ease in the step of kneading when the magnetic toner is produced may have any particle diameters without a limitation. Porous powders collapsible with difficulty may preferably have a primary particle diameter of 15 μm or smaller. Those having a primary particle diameter larger than 15 μm tend to be non-uniformly dispersed in the magnetic toner particles. The porous powder, before it is impregnated with the liquid lubricant, may preferably have a specific surface area, as measured by the BET method using nitrogen gas absorption, of from 10 to 50 $m^2/g$. If its specific surface area is smaller than 10 $m^2/g$, it is difficult to hold the liquid lubricant in a large quantity. If larger than 50 $m^2/g$, the porous powder has so small a pore size that the liquid lubricant can not well permeate through the pores. As a method of impregnating the porous powder with the liquid lubricant, the porous powder may be treated under reduced pressure and the powder thus treated may be immersed in the liquid lubricant to produced the impregnated powder. The porous powder impregnated with the liquid lubricant may preferably be mixed in an amount ranging from 0.1 to 20 parts by weight based on 100 parts by weight of the binder resin. If it is in an amount less than 0.1 part by weight, good lubricity and releasability can be obtained with difficulty. tIf it is in an amount more than 2 parts by weight, the charging performance (or stability) of the magnetic toner may lower. Besides these, it is also possible to use capsule type lubricating particles internally holding the liquid lubricant, or resin particles with the liquid lubricant internally dispersed or held therein or those swelled or impregnated with the liquid lubricant.

In the course where the magnetic toner is produced, the lubricating particle or the collapsed matter is uniformly dispersed in the magnetic toner particles, and hence the liquid lubricant can also be uniformly dispersed in individual magnetic toner particles. Hitherto, in order to uniformly disperse silicone oil in toner, the silicone oil is often adsorbed on supporting particles of various types when used. This method can achieve a superior uniform dispersibility than a method in which the silicone oil is merely directly added. It is important to liberate the liquid lubricant from the supporting particles so that its lubricating effect and release effect can be effectively exhibited and at the same time to make the liquid lubricant held at an appropriate strength so that it can be prevented from being liberated in excess. For this purpose, it is preferable to use the lubricating particles, and the lubricating particles with the liquid lubricant supported on the supporting particles of various types are used.

The presence of the magnetic material or other fine particles on the surfaces of the magnetic toner particles or in the vicinity of the surfaces enables appropriate control of the quantity of the liquid lubricant on the surfaces of the magnetic toner particles. The liquid lubricant is liberated from the lubricating particles to move toward the surfaces of the magnetic toner particles. If the supporting particles have a strong holding power, the liquid lubricant is liberated with difficulty and hence moves to the surfaces of the magnetic toner particles in a smaller quantity. On the other hand, if the supporting particles have a weak holding power, the liquid lubricant is liberated with ease and hence tends to move to the surfaces of the magnetic toner particles in excess. Once the liquid lubricant has been completely liberated from the supporting particles, the lubricity and releasability are no longer effectively exhibited. When the lubricating particles have an appropriate holding power, the liquid lubricant is appropriately liberated from the supporting particles, and hence, even if the liquid lubricant has gone away from the surfaces of the magnetic toner particles, it can be supplemented little by little, so that the lubricity and releasability of the magnetic toner particles can be well maintained. Since supporting particles, the magnetic material or other fine particles, are present on the surfaces of the magnetic toner particles or in the vicinity of the surfaces, it is also possible to again adsorb the liquid lubricant having moved to the surfaces of the magnetic toner particles, so that the liquid lubricant can be prevented from exuding in excess. Thus, the presence of the supporting particles on the surfaces of the magnetic toner particles or in the vicinity of the surfaces is important for holding the liquid lubricant on the surfaces of the magnetic toner particles in an appropriate quantity. This can assists the function to absorb an excess liquid lubricant but immediately supplement the liquid lubricant consumed.

The magnetic toner containing the liquid lubricant in its toner particles exhibits, after elapse of a certain time, the effects of lubricity and releasability in an equilibrated state, where the effects become maximum. Hence, the effects are improved with the elapse of a holding period after the production of the magnetic toner, but are equilibrated with the adsorption attributable to the supporting particles, and hence the liquid lubricant by no means comes to the surfaces of the magnetic toner particles in excess. Meanwhile, application of a heat history of from 30° to 45° C. is preferable since it can shorten the above period and provide a magnetic toner that can exhibit maximum effects in a stable state. Since the heat history also brings about the equilibrated state, the effects are constantly maintained without causing difficulties. The heat history may be applied at any time so long as it is applied after the the magnetic toner particles have been prepared. When produced by pulverization, it is applied after the pulverization.

As to the amount of the liquid lubricant, it is important to add the magnetic material or the lubricating particles so for the liquid lubricant to be in amount of from 0.1 to 7 parts by weight, more preferably from 0.2 to 5 parts by weight, and particularly preferably from 0.3 to 2 parts by weight, based on 100 parts by weight of the binder resin.

In the case when the liquid lubricant is made present outside the magnetic toner particles, i.e., it is externally added from the outside, the lubricating particles supporting the liquid lubricant may be mixed with the magnetic toner particles.

When the liquid lubricant is supported on the supporting particles to make the liquid lubricant present inside the magnetic toner particles and/or outside the magnetic toner particles, the magnetic toner can have the following advantages.

(1) By virtue of an appropriate electrostatic cohesive force acting between the magnetic toner particles on the toner carrying member and the lubricity of individual magnetic toner particles, and also by virtue of an appropriate magnetic binding force to the toner carrying member, the magnetic toner particles can have, in the space of the developing zone, a form close to individual magnetic toner particles themselves rather than the form of ears, so that the magnetic toner particles can move faithfully to the electrostatic latent images.

(2) At the transfer zone where the three, the transfer medium/the magnetic toner/the electrostatic latent image bearing member are present, the group of magnetic toner particles can be well transferred from the surface of the electrostatic latent image bearing member to the transfer medium because of an appropriate adhesion of the liquid lubricant to the surface of the electrostatic latent image bearing member and because of a good releasability possessed by the magnetic toner particles.

(3) At the cleaning zone where the three, the cleaning blade/the toner remaining after transfer/the electrostatic latent image bearing member are present when a cleaning step is provided, the electrostatic cohesive force mutually acting between the magnetic toner particles and the electrostatic attraction force acting to the electrostatic latent image bearing member can be made weak. Also, the liquid lubricant is coated on the surfaces of the electrostatic latent image bearing member and cleaning blade, so that the remaining toner, paper dust and so forth can be readily removed from the surface of the electrostatic latent image bearing member even when the blade is in touch under a slighter pressure, the toner can be prevented from melt-adhereing to the electrostatic latent image bearing member surface having been damaged by electrical discharge, and also any faulty cleaning can be made little occur on the electrostatic latent image bearing member.

(4) Because of the coating of the liquid lubricant on the surfaces of the electrostatic latent image bearing member and cleaning blade and the weak electrostatic cohesive force mutually acting between the magnetic toner particles and also because of the good lubricity, the magnetic toner particles can be readily dispersed in the form of individual particles at the edges of the cleaning blade, and hence the surface of the electrostatic latent image bearing member can be uniformly abraded even when the blade is in touch under a slighter pressure. Hence, images with a high resolution and a high minuteness, substantially made free from image stain, black spots around line images, ground fog and reverse fog that have tended to occur when fine-particle magnetic toners are used, can be obtained and at the same time the faulty cleaning and the toner melt-adhesion can be made little occur, so that the electrostatic latent image bearing member can enjoy a longer lifetime.

The magnetic toner of the present invention can be produced by thoroughly mixing the binder resin, the magnetic material, and optionally the charge control agent and other additives by means of a mixing machine such as a Henschel mixer or a ball mill, thereafter melt-kneading the mixture using a heat kneading machine such as a heat roll, a kneader or an extruder to make the binder resin melt, dispersing or dissolving the magnetic material (and optionally the lubricating particles, the metal compound and the pigment or dye) in the molten product, and solidifying the resulting dispersion or solution by cooling, followed by pulverization and classification. In the step of classification, a multi-division classifier may preferably be used in view of production efficiency.

The magnetic toner of the present invention may be blended with carrier particles when used.

A contact transfer process that can be applied to the image forming method of the present invention will be specifically described below.

In the contact transfer process, the toner image is electrostatically transferred to the transfer medium while pressing a transfer means against the electrostatic latent image bearing member, interposing the transfer medium between them. The transfer means may preferably be brought into pressure contact at a linear pressure of 2.9 N/m (3 g/cm) or higher, and more preferably 19.6 N/m (20 g/cm) or higher. If the linear pressure as contact pressure is lower than 2.9 N/m (3 g/cm), transport aberration of transfer mediums and faulty transfer tend to occur. The toner image may be once transferred from the electrostatic latent image bearing member to an intermediate transfer medium and then the toner image on the intermediate transfer medium may be transferred to the transfer medium through the contact transfer means.

Figure 4:
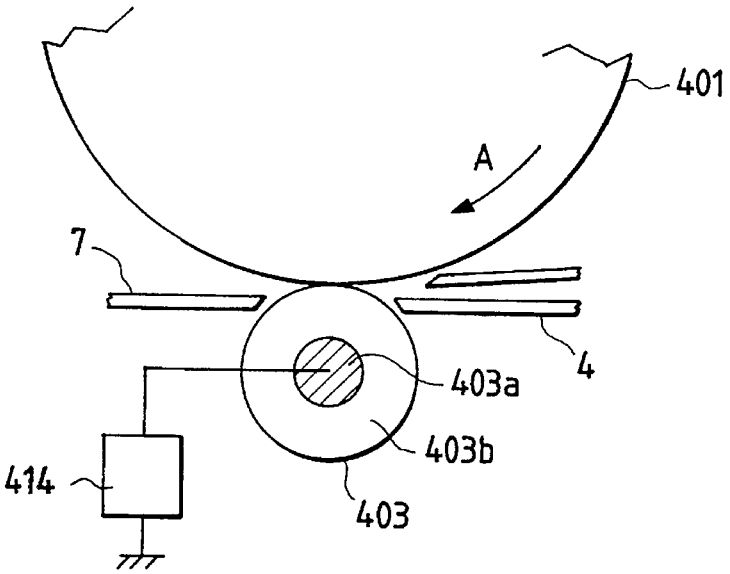
FIG. 4 is a schematic illustration of a transfer means having a transfer roller.

As the transfer means used in the contact transfer process, an assembly having a transfer roller 403 as shown in FIG. 4 or a transfer belt is used. The transfer roller 403 is comprised of at least a mandrel 403*a* and a conductive elastic layer 403*b*. The conductive elastic layer may preferably be made of an elastic material with a volume resistivity of about $10^6$ to $10^{10}$ Ω.cm, such as urethane resin and EPDM having a conductive material such as carbon dispersed therein.

The magnetic toner of the present invention is especially effectively used in an image forming apparatus comprising an electrostatic latent image bearing member whose surface layer is formed of an organic compound. This is because, when the organic compound forms the surface layer of the electrostatic latent image bearing member, the binder resin contained in the magnetic toner particles more tends to adhere to the surface layer than other cases where an inorganic material is used, usually tending to cause a lowering of transfer performance.

The surface material of the electrostatic latent image bearing member according to the present invention may include, for example, silicone resins, vinylidene chloride resins, an ethylene-vinylidene chloride copolymer, a styrene-acrylonitrile copolymer, a styrene-methyl methacrylate copolymer, styrene resins, polyethylene terephthalate, and polycarbonate. Without limitation to these, it is also possible to use resins synthesized from other monomers, or copolymers of the resin monomers previously described, and resin blends.

The magnetic toner of the present invention is effective especially when the surface of the electrostatic latent image bearing member is mainly formed of a polymeric binder, for example, when a protective film mainly formed of a resin is provided on an inorganic electrostatic latent image bearing member comprised of a material such as selenium or amorphous silicon, or when a function-separated organic electrostatic latent image bearing member has as a charge transport layer a surface layer formed of a charge-transporting material and a resin, and when the protective layer as described above is further provided thereon. As a means for imparting releasability to such a surface layer, it is possible (1) to use a material with a low surface energy in the resin itself constituting the film, (2) to add an additive capable of imparting water repellency or lipophilicity, and (3) to disperse in a powdery form a material having a high releasability. In the case of (1), the object is achieved by introducing into the resin structure a fluorine-containing group, a silicone-containing group or the like. In the case of (2), a surface active agent or the like may be used as the additive. In the case of (3), the material may include powders of compounds containing fluorine atoms, i.e., polytetrafluoroethylene, polyvinylidene fluoride, carbon fluoride and so forth. Of these, polytetrafluoroethylene is particularly preferred. In the present invention, the case (3) is particularly preferred, i.e., to disperse the powder with releasability, such as fluorine-containing resin, in the outermost surface layer.

Employment of such means can make the surface of the electrostatic latent image bearing member have a contact angle not smaller than 85 degrees (preferably not smaller than 90 degrees) with respect to water. If it is smaller than 85 degrees, the magnetic toner and the surface of the electrostatic latent image bearing member tend to deteriorate as a result of running on a large number of sheets.

In order to incorporate such powder into the surface, a layer comprising a binder resin with the powder dispersed therein may be provided on the outermost surface of the electrostatic latent image bearing member. Alternatively, in the case of an organic electrostatic latent image bearing member originally mainly comprised of a resin, the powder may be merely dispersed in the outermost layer without anew providing the surface layer.

The powder may preferably be added to the surface layer in an amount of from 1 to 60% by weight, and more preferably from 2 to 50% by weight, based on the total weight of the surface layer. Its addition in an amount less than 1% by weight can be less effective for the improvement in the running performance or durability of the magnetic toner and toner carrying member. Its addition in an amount more than 60% by weight is not preferable since the film strength may lower or the amount of light incident on the electrostatic latent image bearing member may decrease.

The electrostatic latent image bearing member having the contact angle to water of 85 degrees or greater is effective especially in a direct charging method where charging means is a charging member brought into contact with the electrostatic latent image bearing member. Since the load on the surface of the electrostatic latent image bearing member is great in such direct charging, compared with the corona charging where charging means is not in contact with the electrostatic latent image bearing member, such an electrostatic latent image bearing member can be remarkably effective for improving its lifetime, and is one of preferred forms of application.

A preferred embodiment of the electrostatic latent image bearing member used in the present invention will be described below.

It basically comprises a conductive substrate, and a photosensitive layer functionally separated into a charge generation layer and a charge transport layer.

As the conductive substrate, a cylindrical member or a belt is used, comprising a plastic having a coat layer formed of a metal such as aluminum or stainless steel, or formed of an aluminum alloy, an indium oxide-tin oxide alloy or the like, or comprising a paper or plastic impregnated with conductive particles or a plastic having a conductive polymer.

On the conductive substrate, a subbing layer may be provided for the purposes of, e.g., improving adhesion of a photosensitive layer, improving coating properties, protecting the substrate, covering defects on the substrate, improving properties of charge injection from the substrate and protecting the photosensitive layer from electrical breakdown. The subbing layer may be formed of a material such as polyvinyl alcohol, poly-N-vinyl imidazole, polyethylene oxide, ethyl cellulose, methyl cellulose, nitrocellulose, an ethylene-acrylic acid copolymer, polyvinyl butyral, phenol resin, casein, polyamide, copolymer nylon, glue, gelatin, polyurethane or aluminum oxide. The subbing layer may usually be in a thickness of from 0.1 to 10 μm, and preferably from 0.1 to 3 μm.

The charge generation layer is formed by coating a solution prepared by dispersing a charge-generating material in a suitable binder, or by vacuum deposition of the charge-generating material. The charge-generating material includes azo pigments, phthalocyanine pigments, indigo pigments, perylene pigments, polycyclic quinone pigments, squarilium dyes, pyrylium salts, thiopyrylium salts, triphenylmethane dyes, and inorganic substances such as selenium and amorphous silicon. The binder can be selected from a vast range of binder resins, including, for example, resins such as polycarbonate resin, polyester resin, polyvinyl butyral resin, polystyrene resin, acrylic resin, methacrylic resin, phenol resin, silicone resin, epoxy resin and vinyl acetate resin. The binder contained in the charge generation layer may be in an amount not more than 80% by weight, and preferably from 0 to 40% by weight. The charge generation layer may preferably have a thickness of 5 μm or smaller, and particularly from 0.05 to 2 μm.

The charge transport layer has the function to receive charge carriers from the charge generation layer and transport them. The charge transport layer is formed by coating a solution prepared by dispersing a charge-transporting material in a solvent optionally together with a binder resin, and usually may preferably have a layer thickness of from 5 to 40 μm. The charge-transporting material may include polycyclic aromatic compounds having in the main chain or side chain a structure such as biphenylene, anthracene, pyrene or phenanthrene; nitrogen-containing cyclic compounds such as indole, carbazole, oxadiazole and pyrazoline; hydrazone compounds; styryl compounds; and selenium, selenium-tellurium, amorphous silicone, cadmium sulfide or the like.

The binder resin in which the charge-transporting material is dispersed may include resins such as polycarbonate resin, polyester resin, polymethacrylate, polystyrene resin, acrylic resin and polyamide resin; and organic photoconductive polymers such as poly-N-vinyl carbazole and polyvinyl anthracene.

A protective layer may be provided as the surface layer. As resins for the protective layer, resins such as polyester, polycarbonate, acrylic resin, epoxy resin and phenol resin, or a product obtained by curing any of these resins with a curing agent, may be used.

In the resin of the protective layer, conductive fine particles may be dispersed. The conductive fine particles may include particles of a metal, a metal oxide or the like. Preferably, they are ultrafine particles of zinc oxide, titanium oxide, tin oxide, antimony oxide, indium oxide, bismuth oxide, tin oxide-coated titanium oxide, tin-coated indium oxide, antimony-coated tin oxide or zirconium oxide. These may be used alone or may be used in the form of a mixture of two or more kinds. In general, when particles are dispersed in the protective layer, the particles must have a particle diameter smaller than the wavelength of incident light in order to prevent dispersed particles from causing scattering of incident light. Conductive or insulating particles dispersed in the protective layer may preferably have particle diameters of 0.5 μm or smaller. Such particles in the protective layer may preferably be in a content of from 2 to 90% by weight, and more preferably from 5 to 80% by weight, based on the total weight of the protective layer. The protective layer may preferably have a layer thickness of from 0.1 to 10 μm, and more preferably from 1 to 7 μm.

The surface layer can be formed by coating a resin dispersion by spray coating, beam coating or dip coating.

The image forming method of the present invention is effectively applied especially to image forming apparatus having a small-diameter photosensitive drum of 50 mm or smaller diameter. This is because, in the case of the small-diameter photosensitive drum, the curvature with respect to a like linear pressure is so great that the pressure tends to concentrate at the contact portion. The like phenomenon is considered to be seen also belt-like photosensitive members. The present invention is effective also for image forming apparatus whose belt-like photosensitive member forms a curvature radius of 25 mm or smaller at the transfer portion.

Figure 5:
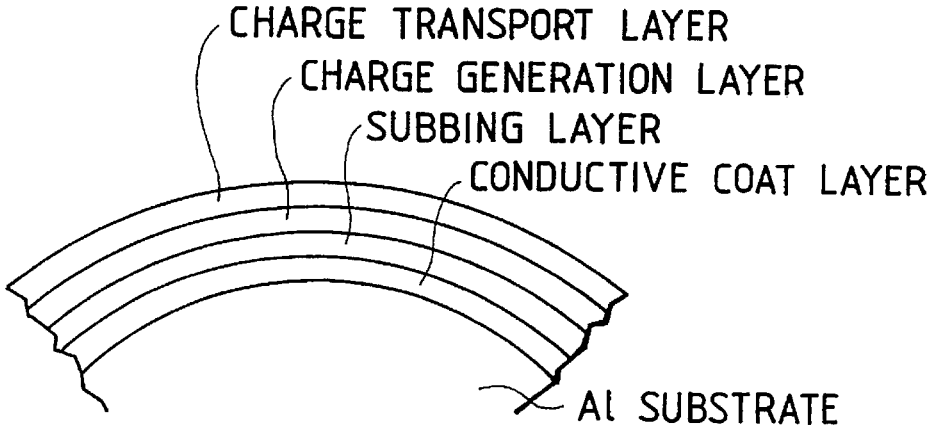
FIG. 5 is a diagrammatic illustration to show the layer configuration of a photosensitive member in Photosensitive Member Production Example 1.

As a preferred example of the electrostatic latent image bearing member, it may have the layer configuration as shown in FIG. 5.

The toner carrying member that carries the magnetic toner of the present invention may preferably be covered with a resin layer containing conductive fine particles.

Figure 6:
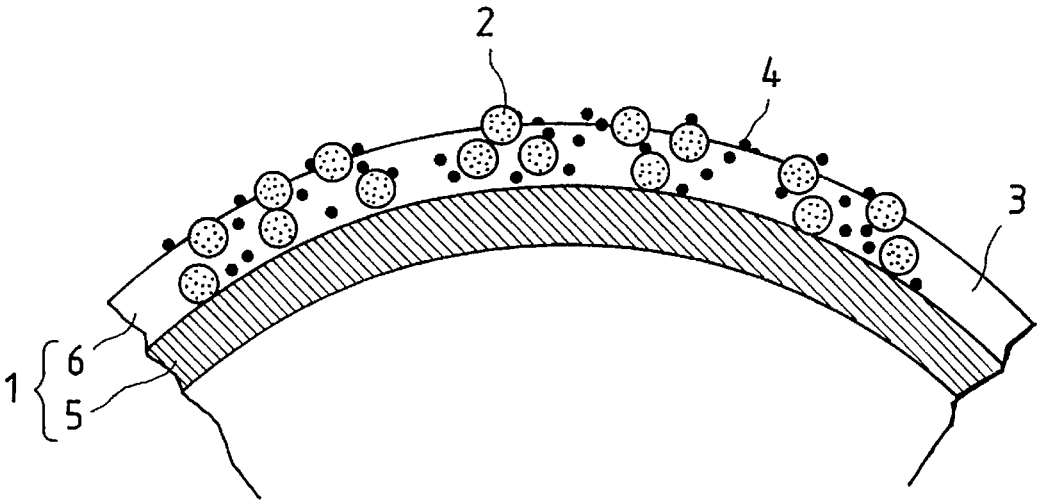
FIG. 6 is a schematic illustration to show the structure of a toner carrying member used in the present invention.

The toner carrying member used in the present invention may preferably have a cylindrical substrate made of aluminum or the like, and a coat layer that covers the substrate surface. The construction of the toner carrying member of the present invention is shown in FIG. 6. As shown in FIG. 6, the toner carrying member, denoted by reference numeral 1, has a substrate 5 and a coat layer 6. The coat layer 6 are comprised of particles 2 for imparting a roughness to the surface of the toner carrying member, a binder resin 3 and a conductive material 4.

The coat layer contains at least the particles for imparting irregularities (roughness) to the surface of the toner carrying member, the conductive material and the binder resin. The particles for imparting a roughness to the surface of the toner carrying member, used in the present invention, may have a number average particle diameter of from 0.05 to 100 μm, preferably from 0.5 to 50 μm, and particularly from 1.0 to 20 μm. If the particles have a number average particle diameter smaller than 0.05 μm, the toner transport performance of the toner carrying member may lower. Those having a number average particle diameter larger than 100 μm are not preferable since the particles tend to come off the coat layer. As examples of the particles for imparting a roughness to the surface of the toner carrying member, preferably used in the present invention, they may include particles of a resin such as PMMA, acrylic resin, polybutadiene resin, polystyrene resin, polyethylene resin, polypropylene, polybutadiene, or a copolymer of any of these, benzoguanamine resin, phenol resin, polyamide resin, nylon, fluorine resin, silicone resin, epoxy resin or polyester resin; and particles of an inorganic compound such as silica, alumina, zinc oxide, titanium oxide, zirconium oxide, calcium carbonate, magnetite, ferrite or glass. As the particles for imparting a roughness to the surface of the toner carrying member, particles having a spherical shape or a closely spherical shape, having the above particle size, are particularly preferably used. It is also possible to use as the particles for imparting a roughness to the surface of the toner carrying member, a mixture of inorganic particles and organic particles. In the above organic particles, cross-linked resin particles are suitable and preferred.

The particles for imparting a roughness to the surface of the toner carrying member may be added to the coat layer in an amount of from 2 to 120 parts by weight based on 100 parts by weight of the binder resin, within the range of which particularly preferable results can be obtained. If they are in an amount less than 2 parts by weight, the addition of spherical particles can be less effective. If in an amount more than 120 parts by weight, the charging performance of the magnetic toner may become too low.

The conductive material used in the coat layer may include carbon black such as furnace black, lamp black, thermal black, acetylene black and channel black; metal oxides such as titanium oxide, tin oxide, zinc oxide, molybdenum oxide, potassium titanate, antimony oxide and indium oxide; metals such as aluminum, copper, silver and nickel; and inorganic fillers such as graphite, metal fiber and carbon fiber. In the present invention, graphite, carbon black, or a mixture of graphite and carbon black is particularly preferably used. The graphite may be a naturally occurring product or an artificially synthesized product, either of which can be used. With regard to the particle diameter preferable for the graphite, it is difficult to absolutely define the diameter since the shape of graphite particles is scaly and may vary during its dispersion when the toner carrying member is produced. As the width in the major axis direction (the cleavage plane direction), it may preferably be 100 μm or smaller. As a method for its measurement, a sample is directly observed on a microscope to measure the size.

The conductive material in the coat layer may be added in an amount of from 10 to 120 parts by weight based on 100 parts by weight of the binder resin, within the range of which particularly preferable results can be obtained. Its addition in an amount more than 120 parts by weight may cause a decrease in coat strength and a decrease in charge quantity of the magnetic toner. If added in an amount less than 10 parts by weight, the coat layer surface tends to be contaminated with toner in some cases.

As the binder resin used in the coat layer of the toner carrying member of the present invention, it is possible to use, for example, thermoplastic resins such as styrene resins, vinyl resins, polyether sulfone resin, polycarbonate resin, polyphenylene oxide resin, polyamide resin, fluorine resin, cellulose resins and acrylic resins; and thermo- or photosetting resins such as epoxy resin, polyester resin, alkyd resin, phenol resin, melamine resin, polyurethane resin, urea resin, silicone resin and polyimide resin. In particular, those having a releasability, such as silicone resin and fluorine resin, or those having a superior mechanical strength, such as polyether sulfone, polycarbonate, polyphenylene oxide, polyamide, phenol, polyester, polyurethane, styrene resins and acrylic resins are more preferred. The surface of the conductive coat layer of the toner carrying member may have a roughness of from 0.2 to 4.5 μm, and preferably from 0.4 to 3.5 μm, as center-line average roughness (hereinafter "Ra"). If the surface roughness is less than 0.2 μm, the toner transport performance may lower to make it impossible to obtain a sufficient image density in some cases. If it is greater than 4.5 μm, the transport quantity of the magnetic toner becomes too large in some cases. It is preferable for the conductive coat layer to usually have a layer thickness of 20 μm or smaller in order to obtain a uniform layer thickness, but without limitation to such a layer thickness.

The magnetic toner of the present invention may be thickness-controlled by means of a resilient member brought into touch with the toner carrying member through the magnetic toner, which is a member to control the layer thickness of the magnetic toner coated on the toner carrying member. This is particularly preferable from the viewpoint of uniform charging of the magnetic toner.

The magnetic toner used in the present invention has a characteristic feature that the inorganic fine powder is present on the surfaces of the magnetic toner particles. This is effective for improving development efficiency, latent image reproducibility and transfer efficiency and for decreasing fog.

The average particle diameter and particle size distribution of the magnetic toner can be measured by various methods using a Coulter counter Model TA-II or Coulter Multisizer (manufactured by Coulter Electronics, Inc.). In the present invention, they are measured using Coulter Multisizer (manufactured by Coulter Electronics, Inc.). An interface (manufactured by Nikkaki k. k.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (Coulter Scientific Japan Co.) may be used. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with diameters of not smaller than 2 μm by means of the above Coulter Multisizer, using an aperture of 100 μm as its aperture. Then the values according to the present invention are determined, which are the volume-based, volume average particle diameter ($D_v$: the middle value of each channel is used as the representative value for each channel) and coefficient of volume variation ($S_v$) which are determined from volume distribution, the number-based, length average particle diameter ($D_1$) and coefficient of length variation ($S_1$) which are determined from number distribution, the weight-based percentage of particles (8.00 μm or larger and 3.17 μm or smaller) determined from the volume distribution and the number-based percentage of particles (5 μm or smaller and 3.17 μm or smaller) determined from the number distribution.

Figure 3:
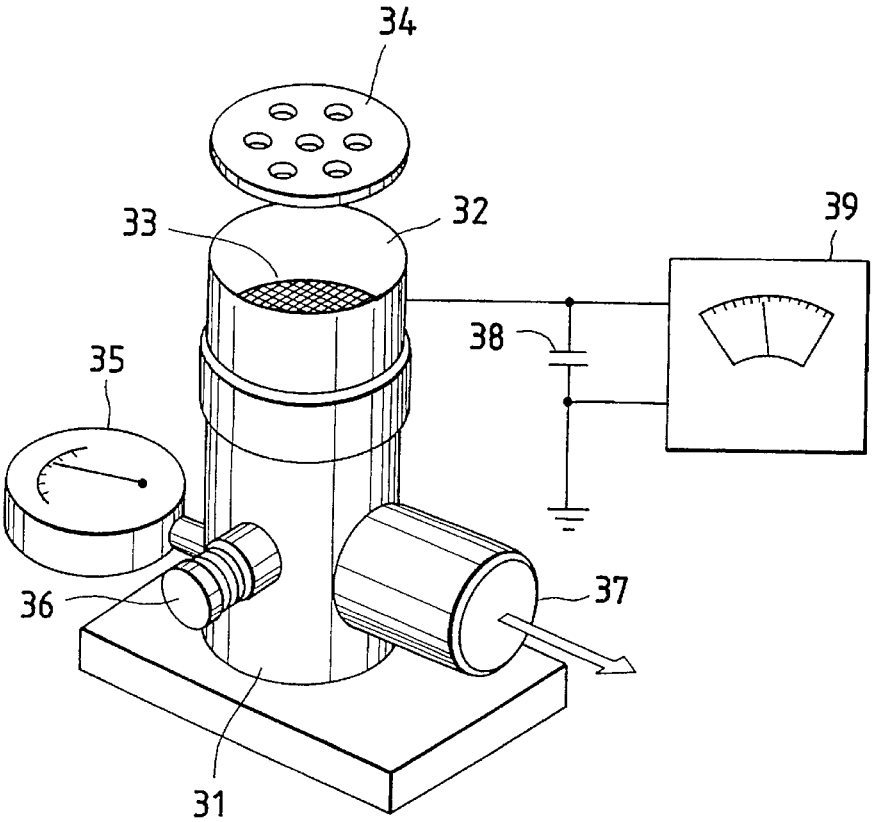
FIG. 3 illustrates a method of measuring the quantity of triboelectricity of a powder.

A method of measuring the quantity of triboelectricity with respect to iron powder, of the magnetic toner according to the present invention will be described with reference to FIG. 3.

In an environment of 23° C. and relative humidity 60% and using an iron powder EFV200/300 (available from Powder Teck Co.) as the iron powder, a mixture prepared by mixing 9.0 g of the iron powder and 1.0 g of the magnetic toner is put in a bottle with a volume of 50 to 100 ml, made of polyethylene, and manually shaked 50 times. Then 1.0 to 1.2 g of the resulting mixture is put in a measuring container 32 made of a metal at the bottom of which a conductive screen 33 of 500 meshes is provided, and the container is covered with a plate 34 made of a metal. The total weight of the measuring container 32 at this time is weighed and is expressed as $W_1$ (g). Next, in a suction device 31 (made of an insulating material at least at the part coming into contact with the measuring container 32), air is sucked from a suction opening 37 and an air-flow control valve 36 is operated to control the pressure indicated by a vacuum indicator 35 to be 2,450 hPa (250 mmAq). In this state, suction is carried out for 1 minute to remove the magnetic toner by suction. The potential indicated by a potentiometer 39 at this time is expressed as V (volt). Herein, the numeral 38 denotes a capacitor, whose capacitance is expressed as C (μF). The total weight of the measuring container after completion of the suction is also weighed and is expressed as $W_2$ (g). The quantity of triboelectricity (mC/g) of the magnetic toner is calculated as shown by the following expression.

$$\text{Quantity of triboelectricity } (mC/g) = CV/(W_1 - W_2)$$

Magnetic properties of the magnetic toner are measured using VSM-P-1-15 (manufactured by Toei Kogyo) at room temperature under an external magnetic field of 79.6 kA/m (1,000 oersteds).

The specific surface area is measured according to the BET method, where nitrogen gas is adsorbed on sample surfaces using a specific surface area measuring device AUTOSOBE 1 (manufactured by Yuasa Ionics Co.), and the specific surface area is calculated by the BET multiple point method.

The image forming method of the present invention will be specifically described below.

In FIG. 1, reference numeral 100 denotes an electrostatic latent image bearing member (e.g., a photosensitive drum), around which a primary charging roller 117, a developing assembly 140, a transfer charging roller 114, a cleaning means 116 and a resistor roller 124 and so forth are provided.

Then the photosensitive drum 100 is charged to −700 V by the operation of the primary charging roller 117 (applied voltage: AC voltage of −2.0 kVpp and DC voltage of −700 Vdc). The photosensitive drum 100 is irradiated with laser light 123 through a laser light generator 121 to carry out exposure to form an electrostatic latent image. The electrostatic latent image on the photosensitive drum 100 is developed by the magnetic toner supplied from the developing assembly 140, and the magnetic toner image thus formed is transferred to a transfer medium by the operation of the transfer roller 114, brought into contact with the photosensitive drum interposing the transfer medium between them. The transfer medium holding the toner image is transported to a heat and pressure fixing assembly 126 by means of the transport belt 125, and fixed to the transfer medium. The magnetic toner remaining on the photosensitive drum 100 is removed by a cleaning blade of the cleaning means 116.

Figure 2:
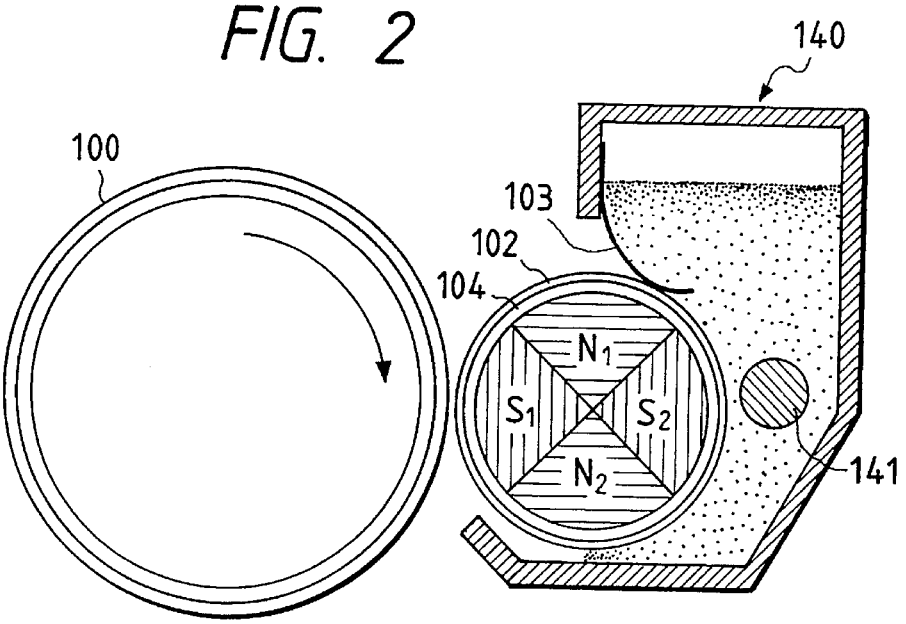
FIG. 2 is an enlarged view of the developing zone of the image forming apparatus.

As shown in FIG. 2, the developing assembly 140 is provided, in proximity to the photosensitive drum 100, with a cylindrical toner carrying member 102 (hereinafter "developing sleeve") made of a non-magnetic material, and the gap between the photosensitive drum 100 and the developing sleeve 102 is set at, for example, about 300 μm by the aid of a sleeve-to-drum distance holding member or the like (not shown). In the developing assembly 140, an agitating rod 141 is provided. The developing sleeve 102 is internally provided with a magnet roller 104 serving as a magnetic field generating means, which is secured concentrically with the developing sleeve 102. The developing sleeve 102 is set rotatable. The magnet roller 104 has a plurality of magnetic poles as shown in the drawing. Magnetic pole S1 affects development; N1, control of toner layer thickness (toner coat quantity); S2, intake and transport of the toner; and N2, prevention of the magnetic toner from spouting. As a member to control the layer thickness of the magnetic toner transported while adhering to the developing sleeve 102, a resilient blade 103 is provided so that the layer thickness of the magnetic toner transported to the development zone is controlled according to the pressure under which the resilient blade 103 is brought in touch with the developing sleeve 102. In the developing zone, DC and AC development bias is applied to the developing sleeve 102, and the magnetic toner on the developing sleeve 102 is moved onto the photosensitive drum 100 in conformity with the electrostatic latent image to form the toner image.

The present invention will be specifically described below by giving Production Examples and Examples, which, however, by no means limit the present invention. In the following formulation, "part(s)" refers to "part(s) by weight" in all occurrences.

Production Examples for Liquid Lubricant Supported Magnetic Material

Based on 100 parts of magnetic iron oxide (BET specific surface area: 7.8 $m^2/g$; σs: 60.5 $Am^2/kg$ (emu/g), a predetermined amount of a liquid lubricant was put into a Simpson mix muller (MPVU-2, manufactured by Matsumoto Chuzo K. K.), and the mixer was operated at room temperature for 30 minutes, followed by loosening of agglomeration of particles by means of a hammer mill to obtain a magnetic material A with the liquid lubricant supported thereon. Similarly, various kinds of liquid lubricants were respectively made supported on various kinds of magnetic materials. Magnetic materials A to D with the liquid lubricant supported thereon, thus obtained, had physical properties as shown in Table 1. An untreated product (with no liquid lubricant supported thereon) of the magnetic material A was prepared as magnetic material E, and an untreated product of the magnetic material C was prepared as magnetic material F.

TABLE 1

| | Supporting particles | | Liquid lubricant | | |
|---|---|---|---|---|---|
| | Type | BET specific surface area ($m^2/g$) | Type | Viscosity (cSt) | Support weight (wt. %) |
| Magnetic material: | | | | | |
| A | Spherical magnetite | 7.8 | Dimethylsilicone | 1,000 | 1.2 |
| B | Spherical magnetite | 7.8 | Dimethylsilicone | 300 | 1 |
| C | Spherical magnetite | 7.8 | Methylphenylsilicone | 1,000 | 1.5 |
| D | Octahedral magnetite | 11 | Dimethylsilicone | 1,000 | 1.2 |
| E | Spherical magnetite | 7.8 | — | — | — |
| F | Octahedral magnetite | 11 | — | — | — |

Production Examples for Liquid Lubricant Supported Lubricating Particles

While the supporting fine particles (silica) for making the liquid lubricant supported thereon were agitated in a Henschel mixer, a liquid lubricant diluted with n-hexane was dropwise added. After the addition was completed, the n-hexane was removed under reduced pressure with stirring, followed by pulverization using a hammer mill to obtain lubricating particles A with the liquid lubricant supported thereon. Similarly, various kinds of liquid lubricants were respectively made supported on various kinds of supporting fine particles. Lubricating particles A to D with the liquid lubricant supported thereon, thus obtained, had physical properties as shown in Table 2. An untreated product of the silica used in the preparation of the lubricating particles A was prepared as particles E.

TABLE 2

| | Supporting particles | | Liquid lubricant | | |
|---|---|---|---|---|---|
| | Type | BET specific surface area ($m^2/g$) | Type | Viscosity (cSt) | Support weight (wt. %) |
| Lubricating particles: | | | | | |
| A | Dry-process silica | 200 | Dimethylsilicone | 50,000 | 60 |
| B | Dry-process silica | 300 | Dimethylsilicone | 10,000 | 50 |
| C | Dry-process silica | 130 | Methylphenylsilicone | 50,000 | 60 |
| D | Titanium oxide | 50 | Dimethylsilicone | 50,000 | 40 |
| E | Dry-process silica | 200 | — | — | — |

Magnetic Toner Production Example 1

| | |
|---|---|
| Magnetic material A | 100 parts |
| Styrene/n-butyl acrylate/n-butylmaleic half ester copolymer (copolymerization ratio: 8:2; Mw: 260,000) | 100 parts |
| Iron complex of monoazo dye (negative charge control agent) | 2 parts |
| Low-molecular weight polyolefin (release agent) | 3 parts |

The above materials were mixed using a blender, and then melt-kneaded using a twin-screw extruder heated to 140° C. The kneaded product obtained was cooled, and then crushed with a hammer mill. The crushed product was finely pulverized by means of a jet mill, and the finely pulverized product thus obtained was classified using an air classifier to obtain a black fine powder. To the black fine powder thus obtained, 1.2% by weight of hydrophobic fine silica powder (treated with hexamethyldisilazane; BET specific surface area: 200 $m^2/g$) was added, which were then agitated and mixed by means of a Henschel mixer, followed by removal of coarse particles using a 150 mesh sieve to obtain magnetic toner A-1. The magnetic toner A-1 obtained had a weight average particle diameter of 5.0 μm. Physical properties of the magnetic toner are shown in Table 3.

Magnetic Toner Production Examples 2 and 3

Black fine powders were obtained in the same manner as in Magnetic Toner Production Example 1 except that the magnetic material A was replaced with the magnetic materials B and C, respectively, and their particle diameter and particle size distribution were changed.

To 100 parts of the black fine powders each, 1.5 parts of hydrophobic fine silica powder (the same one as used in Magnetic Toner Production Example 1) was added, and the subsequent procedure of Magnetic Toner Production Example 1 was repeated to obtain magnetic toners B-1 and C-1, respectively. Physical properties of the magnetic toners obtained are shown in Table 3.

Magnetic Toner Production Example 4

| | |
|---|---|
| Magnetic material D | 120 parts |
| Polyester resin | 100 parts |
| Iron complex of monoazo dye (negative charge control agent) | 2 parts |
| Low-molecular weight polyolefin (release agent) | 3 parts |

Magnetic toner D-1 was obtained in the same manner as in Magnetic Toner Production Example 1 except that the above materials were used and, to the black fine powder obtained, 1.0% by weight of hydrophobic fine silica powder (treated with hexamethyldisilazane; BET specific surface area: 380 $m^2/g$) was added. Physical properties of the magnetic toner D-1 thus obtained are shown in Table 3.

Magnetic Toner Production Comparative Example 1

Magnetic toner E-1 was obtained in the same manner as in Magnetic Toner Production Example 1 except that 100 parts of the untreated magnetic material E was used as the magnetic material. Physical properties of the magnetic toner E-1 obtained are shown in Table 3.

Magnetic Toner Production Comparative Example 2

Magnetic toner F-1 was obtained in the same manner as in Magnetic Toner Production Example 1 except that 100 parts of the untreated magnetic material F was used as the magnetic material. Physical properties of the magnetic toner F-1 obtained are shown in Table 3.

Magnetic Toner Production Example 5

| | |
|---|---|
| Magnetic material E | 80 parts |
| Styrene/n-butyl acrylate copolymer (copolymerization ratio: 8:2; Mw: 260,000) | 100 parts |
| Lubricating particles A | 1 part |
| Iron complex of monoazo dye (negative charge control agent) | 2 parts |
| Low-molecular weight ethylene/propylene copolymer | 3 parts |

A black fine powder was obtained in the same manner as in Magnetic Toner Production Example 1 except that the above materials were used. To 100 parts of this black fine powder, 1.2 parts of hydrophobic fine silica powder (the same one as used in Magnetic Toner Production Example 1) was added, and the subsequent procedure of Magnetic Toner Production Example 1 was repeated to obtain magnetic toner G-1. Physical properties of the magnetic toner G-1 obtained are shown in Table 3.

Magnetic Toner Production Examples 6 and 7

Magnetic toners H-1 and I-1 were obtained in the same manner as in Magnetic Toner Production Example 5 except that the lubricating particles A was replaced with the lubricating particles B and C, respectively, and the inorganic fine powder subjected to organic treatment was added in a different amount. Physical properties of the magnetic toners H-1 and I-1 thus obtained are shown in Table 3.

Magnetic Toner Production Example 8

| | |
|---|---|
| Magnetic material D | 100 parts |
| Polyester resin | 100 parts |
| Lubricating particles D | 1 part |
| Iron complex of monoazo dye (negative charge control agent) | 2 parts |
| Low-molecular weight polyolefin (release agent) | 3 parts |

A black fine powder was obtained in the same manner as in Magnetic Toner Production Example 1 except that the above materials were used. To 100 parts of this black fine powder, 1.2 parts of hydrophobic fine silica powder (the same one as used in Magnetic Toner Production Example 1) was added, and the subsequent procedure of Magnetic Toner Production Example 1 was repeated to obtain magnetic toner J-1. Physical properties of the magnetic toner J-1 obtained are shown in Table 3.

Magnetic Toner Production Comparative Example 3

Magnetic toner K-1 was obtained in the same manner as in Magnetic Toner Production Example 8 except that the lubricating particles D were replaced with the untreated particles E. Physical properties of the magnetic toner K-1 thus obtained are shown in Table 3.

TABLE 3

| | Weight average particle diameter (μm) | Volume average particle diameter (μm) | Magnetic toner particles with: Particle diameters of: 5 μm or smaller (% by number) | 3.17 μm or smaller (% by number) | Nr/Nv* | Particle diameters of 8 μm or larger (% by volume) | Quantity of triboelectricity of magnetic toner (μC/g) |
|---|---|---|---|---|---|---|---|
| Magnetic toner: | | | | | | | |
| A-1 | 5.0 | 4.2 | 82 | 25 | 4.1 | 1 | −35 |
| B-1 | 5.5 | 4.8 | 77 | 21 | 4.3 | 2 | −33 |
| C-1 | 5.8 | 5.0 | 65 | 14 | 5.3 | 8 | −30 |
| D-1 | 4.5 | 3.6 | 85 | 34 | 3.6 | 1 or less | −37 |
| E-1** | 7.0 | 6.1 | 40 | 6 | 15 | 23 | −23 |
| F-1** | 9.5 | 8.9 | 12 | 2 | 22 | 70 | −19 |
| G-1 | 5.1 | 4.3 | 83 | 26 | 3.8 | 1 | −32 |
| H-1 | 5.5 | 4.7 | 79 | 20 | 4 | 2 | −30 |
| I-1 | 5.8 | 4.9 | 67 | 17 | 3.2 | 7 | −29 |
| J-1 | 4.6 | 3.5 | 82 | 28 | 4.1 | 1 or less | −38 |
| K-1** | 8.5 | 7.8 | 30 | 4 | 18 | 44 | −23 |

*Ratio of (% by number)/(% by volume) of magnetic toner particles with particle diameters of 3.17 μm or smaller
**Comparative Example

EXAMPLE 1

The magnetic toner A-1 was used, and the apparatus as shown in FIG. 1 was used as an image forming apparatus.

As an electrostatic latent image bearing member, an organic photoconductor (OPC) photosensitive drum of 24 mm diameter having a surface layer formed of polycarbonate was used and was made to have a dark portion potential $V_D$ of −700 V and a light portion potential $V_L$ of −210 V. The photosensitive drum and a developing sleeve described below were so set as to leave a gap of 300 μm between them. A developing sleeve comprising an aluminum cylinder of 12 mm diameter with a mirror-finished surface and formed thereon a resin layer having the following composition and having a layer thickness of about 7 μm and a center-line average roughness (Ra) of 0.8 μm was used as a toner carrying member; development magnetic pole: 950 gausses. As a toner layer control member, a urethane rubber blade of 1.0 mm thick and 10 mm in free length was brought into touch with the surface of the developing sleeve at a linear pressure of 15 g/cm.

Resin layer composition:

| | |
|---|---|
| Phenol resin | 100 parts |
| Graphite (particle diameter: about 7 μm) | 90 parts |
| Carbon black | 10 parts |

Then, as development bias, DC bias component Vdc of −500 V and superimposing AC bias component Vpp of 1,200 V and f=2,000 Hz were applied to the developing sleeve. The developing sleeve was rotated at a peripheral speed of 150% (36 mm/sec) with respect to the peripheral speed of the photosensitive drum (24 mm/sec) and in the regular direction thereto (the opposite direction when viewed as the rotational direction).

A transfer roller as shown in FIG. 4 [made of ethylene-propylene rubber with conductive carbon dispersed therein; volume resistivity of the conductive resilient layer: $10^8$ Ω.cm; surface-rubber hardness: 24 degrees; diameter: 20 mm; contact pressure: 49 N/m (50 g/cm)] was set rotary at a speed equal to the peripheral speed of the photosensitive drum (24 mm/sec), and a transfer bias of +2,000 V was applied. As a toner, the magnetic toner A-1 was used and images were reproduced in an environment of 23° C., 65% RH. As transfer paper, paper with a basis weight of 75 g/m$^2$ was used.

As a result, as shown in Table 4, good images were obtained, which were free from blank areas caused by poor transfer and had a sufficient image density and a high resolution. Also, 50 μm isolated-dot latent images showed resolution at a very good level. After further continuous printing on 5,000 sheets, there was seen no changes on the surface of the photosensitive drum, e.g., no melt-adhesion of toner.

In the present Example, black spots around line images are evaluated on minute fine lines concerned with the image quality of graphical images, and are evaluated on 100 μm line images, around which the black spots more tend to occur than black spots around lines of characters.

Figure 8:
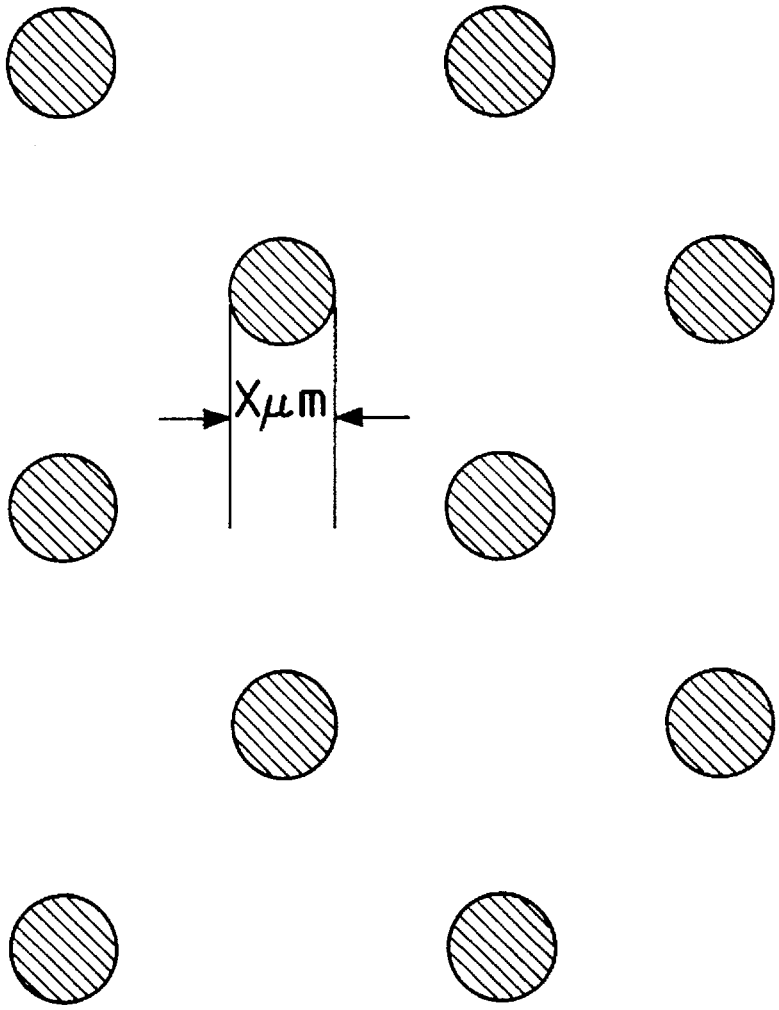
FIG. 8 shows an example of an isolated-dot pattern used in the evaluation of resolution.

The resolution was evaluated by examining the reproducibility of small-diameter isolated dots as shown in FIG. 8, which tend to form closed electric fields on account of latent image electric fields and are difficult to reproduce.

A pattern of characters printed on A4-size paper in an area percentage of 4% was continuously printed out on 500 sheets from the initial stage, and toner consumption was determined from changes in the toner quantity in the developing assembly to find that it was 0.025 g/sheet. Also, on the photosensitive drum, 600 dpi 10-dot vertical line pattern latent images (line width: about 420 μm) were drawn at intervals of 1 cm by laser exposure, which were then developed, and the developed images were transferred onto an OHP sheet made of PET and fixed thereto. Vertical line pattern images thus formed were analyzed using a surface profile analyzer SURFCORDER SE-30H (manufactured by Kosaka Kenkyusho Co.). How the toner was laid on the vertical lines was observed as a profile of surface roughness, and their line width was determined from the width of this profile. As a result, the line width was 430 μm and the line images were reproduced at a high density and sharpness. Thus, it was confirmed that a low toner consumption was achieved while maintaining the latent image reproducibility.

Example 1. As a result, images with conspicuous blank areas caused by poor transfer and with many black spots around line images were obtained. After continuous printing on 5,000 sheets, there was seen melt-adhesion of toner on the surface of the photosensitive drum, which appeared as blank areas on the printed images. As to the resolution of 100 μm isolated-dot latent images also, images having an insufficient resolution were formed.

EXAMPLES 2 to 8

Using as toners the magnetic toners B-1 to D-1 and G-1 to J-1, images were reproduced using the same apparatus and conditions as in Example 1. Results obtained are shown in Table 4.

Comparative Example 3

Using as a toner the magnetic toner K-1, images were reproduced using the same apparatus and conditions as in Example 1. As a result, images with many black spots around characters and with conspicuous blank areas caused by poor transfer were formed. After continuous printing on 5,000 sheets, there was seen melt-adhesion of toner on the surface of the photosensitive drum, which appeared as blank areas on the printed images.

TABLE 4

| | * Image density | ** Black spots around line images | Blank areas caused by poor transfer | Resolution (isolated-/dot image) 100 μm | 50 μm | Magnetic toner consumption (g/sheet) | Melt-adhesion of toner on photo-sensitive member |
|---|---|---|---|---|---|---|---|
| Example: | | | | | | | |
| 1 | 1.44 | A | A | A | A | 0.037 | A |
| 2 | 1.45 | A | A | A | A | 0.036 | A |
| 3 | 1.46 | A | A | A | B | 0.040 | A |
| 4 | 1.4 | A | A | A | A | 0.038 | A |
| 5 | 1.45 | A | A | A | A | 0.038 | A |
| 6 | 1.45 | A | A | A | A | 0.035 | A |
| 7 | 1.48 | A | A | A | B | 0.041 | A |
| 8 | 1.44 | A | A–B | A | A | 0.040 | A |
| Comparative Example: | | | | | | | |
| 1 | 1.46 | A | C | A | C | 0.048 | C |
| 2 | 1.48 | C | C | C | C | 0.064 | C |
| 3 | 1.45 | B | C | B | C | 0.060 | C |

*of 5 mm × 5 mm solid black images
**around 100 μm wide horizontal lines

Comparative Example 1

Figure 7A:
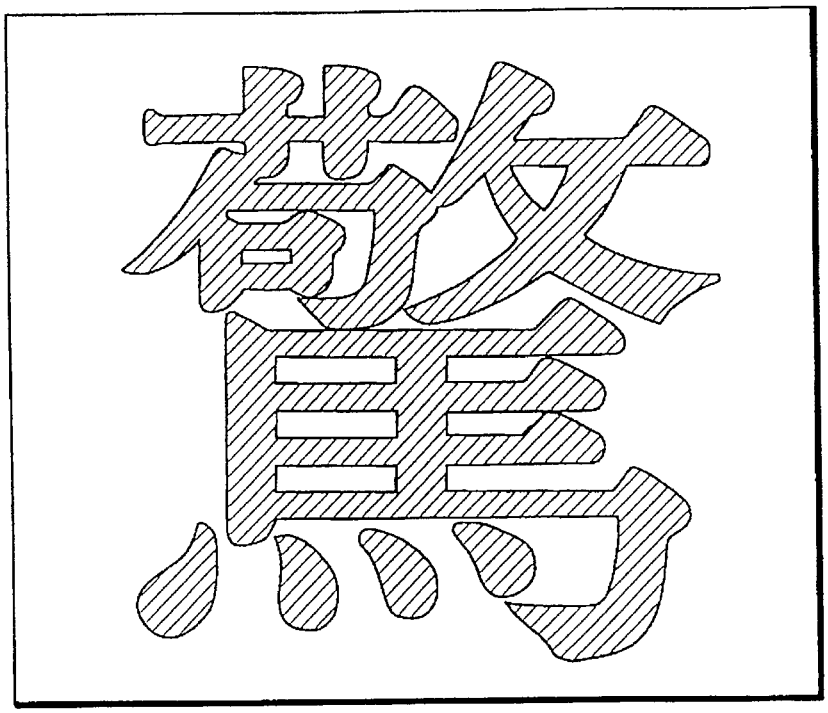
FIGS. 7A and 7B illustrate a good image free of "blank areas caused by poor transfer" (FIG. 7A), and an image where the "blank areas caused by poor transfer" have occurred (FIG. 7B).
Figure 7B:
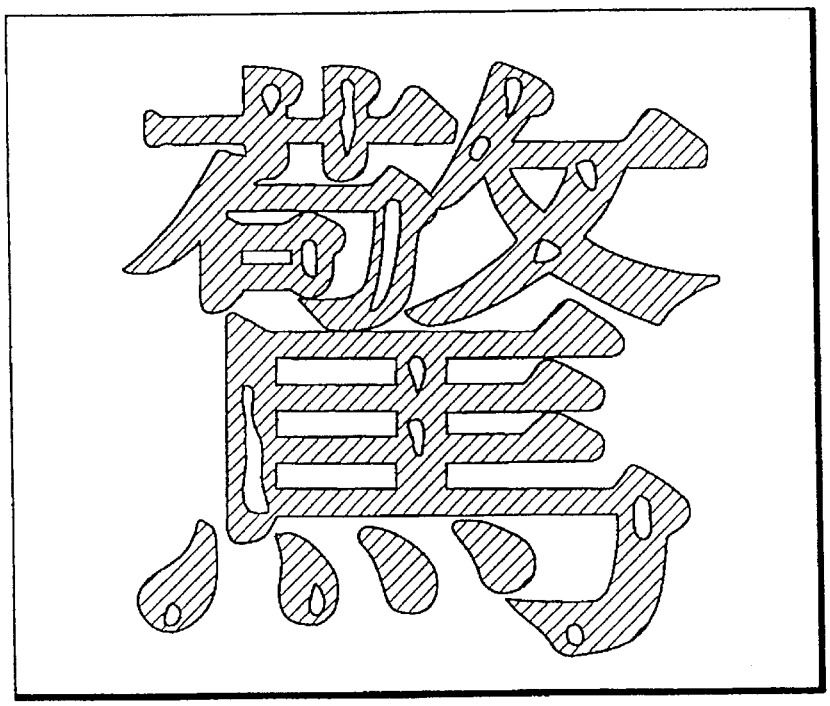

Using as a toner the magnetic toner E-1, images were reproduced using the same apparatus and conditions as in Example 1. As a result, as shown in Table 4, images with conspicuous black spots around characters and with conspicuous blank areas caused by poor transfer (see FIG. 7B) were formed. As to the resolution of 50 μm isolated-dot latent images also, images having an insufficient resolution and lacking in sharpness were obtained. After continuous printing on 5,000 sheets, there was seen melt-adhesion of toner on the surface of the photosensitive drum, which appeared as blank areas on the printed images.

Comparative Example 2

Using as a toner the magnetic toner F-1, images were reproduced using the same apparatus and conditions as in

Photosensitive Member Production Example 1

To produce a photosensitive member, an aluminum cylinder of 30 mm diameter and 254 mm long was used as a substrate. On this substrate, the layers with the configuration as shown in FIG. 5 were successively superposingly formed by dip coating to produce a photosensitive member.

(1) Conductive coat layer: Mainly formed of phenol resin with tin oxide powder and titanium oxide powder dispersed therein. Layer thickness: 15 μm.

(2) Subbing layer: Mainly formed of modified nylon and copolymer nylon. Layer thickness: 0.6 μm.

(3) Charge generation layer: Mainly formed of butyral resin with an azo pigment dispersed therein, the azo pigment having an absorption in the region of long wavelength. Layer thickness: 0.6 μm.

(4) Charge transport layer: Mainly formed of polycarbonate resin (molecular weight as measured by Ostwald viscometry: 20,000) with a hole-transporting triphenylamine compound dissolved therein in a weight ratio of 8:10, followed by further addition of polytetrafluoroethylene powder (average particle diameter: 0.2 μm) in an amount of 10% by weight based on the total weight of solid contents and then uniform dispersion. Layer thickness: 25 μm. The contact angle to water was 95 degrees.

The contact angle was measured using pure water, and using as a measuring device a contact angle meter Model CA-DS, manufactured by Kyowa Kaimen Kagaku K. K.

Photosensitive Member Production Example 2

The procedure of Photosensitive Member Production Example 1 was repeated to produce a photosensitive member, except that the polytetrafluoroethylene powder was not added. The contact angle to water was 74 degrees.

Photosensitive Member Production Example 3

To produced a photosensitive member, the procedure of Photosensitive Member Production Example 1 was repeated up to the formation of the charge generation layer. The charge transport layer was formed using a solution prepared by dissolving the hole-transporting triphenylamine compound in the polycarbonate resin in a weight ratio of 10:10, and in a layer thickness of 20 μm. To further form a protective layer thereon, a composition prepared by dissolving the like materials in a weight ratio of 5:10, followed by addition of polytetrafluoroethylene powder (average particle diameter: 0.2 μm) in an amount of 30% by weight based on the total weight of solid contents and then uniform dispersion, was spray coated on the charge transport layer, in a layer thickness of 5 μm. The contact angle to water was 102 degrees.

Production Examples for Liquid Lubricant Supported Lubricating Particles

While the supporting fine particles (silica) for making the liquid lubricant supported thereon were agitated in a Henschel mixer, a liquid lubricant diluted with n-hexane was dropwise added. After the addition was completed, the n-hexane was removed under reduced pressure with stirring, followed by pulverization using a hammer mill to obtain lubricating particles 1 with the liquid lubricant supported thereon. Similarly, various kinds of liquid lubricants were respectively made supported on various kinds of supporting fine particles. Lubricating particles 1 to 9 with the liquid lubricant supported thereon, thus obtained, had physical properties as shown in Table 5. An untreated product of the silica used in the preparation of the lubricating particles 1 was prepared as particles 10.

TABLE 5

| | Supporting particles | | Liquid lubricant | | |
|---|---|---|---|---|---|
| | Type | BET specific surface area ($m^2/g$) | Type | Viscosity (cSt) | Support weight (wt. %) |
| Lubricating particles: | | | | | |
| 1 | Dry-process silica | 200 | Dimethylsilicone | 50,000 | 60 |
| 2 | Dry-process silica | 300 | Dimethylsilicone | 10,000 | 80 |
| 3 | Dry-process silica | 130 | Dimethylsilicone | 30,000 | 50 |
| 4 | Wet-process silica | 110 | Dimethylsilicone | 10,000 | 40 |
| 5 | Titanium oxide | 50 | Dimethylsilicone | 5,000 | 30 |
| 6 | Alumina | 120 | Dimethylsilicone | 3,000 | 25 |
| 7 | Dry-process silica | 200 | Methylphenylsilicone | 100,000 | 70 |
| 8 | Dry-process silica | 200 | Dimethylsilicone* | 1,000 | 40 |
| 9 | Dry-process silica | 200 | Perfluoropolyether | 250 | 30 |

*containing trifluoropropyl groups

Magnetic Toner Production Example 9

| | |
|---|---|
| Magnetic material (spherical magnetite) | 100 parts |
| Styrene/n-butyl acrylate/n-butylmaleic half ester copolymer (copolymerization ratio: 8:2; Mw: 260,000) | 100 parts |
| Iron complex of monoazo dye (negative charge control agent) | 2 parts |
| Low-molecular weight polyolefin/ (release agent) | 4 parts |

The above materials were mixed using a blender, and then melt-kneaded using a twin-screw extruder heated to 140° C. The kneaded product obtained was cooled, and then crushed with a hammer mill. The crushed product was finely pulverized by means of a jet mill, and the finely pulverized product thus obtained was classified using an air classifier to obtain magnetic toner particles. To the magnetic toner particles thus obtained, 1.2% by weight of hydrophobic fine silica powder (treated with hexamethyldisilazane; BET specific surface area: 200 $m^2/g$) and 0.4% by weight of the lubricating particles 1 were added, which were then agitated and mixed by means of a Henschel mixer, followed by removal of coarse particles using a 150 mesh sieve to obtain magnetic toner 9. The magnetic toner 9 obtained had a weight average particle diameter of 5.1 μm. Physical properties of the magnetic toner are shown in Table 6.

Magnetic Toner Production Examples 10 and 11

Magnetic toner particles were obtained in the same manner as in Magnetic Toner Production Example 9 except that their particle diameter and particle size distribution were changed. To 100 parts of the magnetic toner particles obtained, 1.5% by weight of hydrophobic fine silica powder (the same one as used in Magnetic Toner Production Example 9) and 0.5% by weight of the lubricating particles 2 were added, and the subsequent procedure of Magnetic Toner Production Example 9 was repeated to obtain magnetic toner 10. Similarly, to 100 parts of the magnetic toner particles, 1.8% by weight of hydrophobic fine silica powder (the same one as used in Magnetic Toner Production Example 9) and 0.3% by weight of the lubricating particles 3 were added, to obtain magnetic toner 11. Physical properties of the magnetic toners 10 and 11 thus obtained are shown in Table 6.

Magnetic Toner Production Example 12

| | |
|---|---|
| Magnetic material (spherical magnetite) | 120 parts |
| Styrene/n-butyl acrylate copolymer (copolymerization ratio: 8:2; Mw: 260,000) | 100 parts |
| Iron complex of monoazo dye (negative charge control agent) | 2 parts |
| Low-molecular weight ethylene/propylene copolymer | 3 parts |

Magnetic toner particles were obtained in the same manner as in Magnetic Toner Production Example 9 except that the above materials were used. To 100 parts of the magnetic toner particles obtained, 1.2% by weight of hydrophobic fine silica powder (treated with silicone oil and hexamethyldisilazane; BET specific surface area: 120 $m^2/g$) and 0.2% by weight of the lubricating particles 4 were added, and the subsequent procedure of Magnetic Toner Production Example 9 was repeated to obtain magnetic toner 12. Physical properties of the magnetic toner 12 obtained are shown in Table 6.

Magnetic Toner Production Example 13

Magnetic toner particles were obtained in the same manner as in Magnetic Toner Production Example 9 except that their particle diameter and particle size distribution were changed. To 100 parts of the magnetic toner particles obtained, 1.8% by weight of hydrophobic fine silica powder (the same one as used in Magnetic Toner Production Example 12) and 0.3% by weight of the lubricating particles 5 were added, and the subsequent procedure of Magnetic Toner Production Example 9 was repeated to obtain magnetic toner 13. Physical properties of the magnetic toner 13 thus obtained are shown in Table 6.

Magnetic Toner Production Examples 14 and 15

Magnetic toner particles were obtained in the same manner as in Magnetic Toner Production Example 9 except that their particle diameter and particle size distribution were changed. To 100 parts of the magnetic toner particles obtained, 1.5% by weight of hydrophobic fine silica powder (the same one as used in Magnetic Toner Production Example 12) and 0.5% by weight of the lubricating particles 6 were added, and the subsequent procedure of Magnetic Toner Production Example 9 was repeated to obtain magnetic toner 14. Similarly, to 100 parts of the magnetic toner particles, 1.0% by weight of hydrophobic fine silica powder (the same one as used in Magnetic Toner Production Example 9) and 0.3% by weight of the lubricating particles 7 were added, to obtain magnetic toner 15. Physical properties of the magnetic toners 14 and 15 thus obtained are shown in Table 6.

Magnetic Toner Production Examples 16 and 17

Magnetic toner particles were obtained in the same manner as in Magnetic Toner Production Example 9. To 100 parts of the magnetic toner particles obtained, 1.5% by weight of hydrophobic fine silica powder (the same one as used in Magnetic Toner Production Example 9) and 0.5% by weight of the lubricating particles 8 were added, and the subsequent procedure of Magnetic Toner Production Example 9 was repeated to obtain magnetic toner 16. Similarly, to 100 parts of the magnetic toner particles, 1.5% by weight of hydrophobic fine silica powder (the same one as used in Magnetic Toner Production Example 9) and 0.7% by weight of the lubricating particles 9 were added, to obtain magnetic toner 17. Physical properties of the magnetic toners 16 and 17 thus obtained are shown in Table 6.

Magnetic Toner Production Comparative Example 4

Magnetic toner 18 was obtained in the same manner as in Magnetic Toner Production Example 9 except that magnetic toner particles made to have different particle diameter and particle size distribution were used and the lubricating particles 1 were not added. Physical properties of the magnetic toner 18 thus obtained are shown in Table 6.

TABLE 6

| | Weight average particle diameter (μm) | Volume average particle diameter (μm) | Magnetic toner particles with: Particle diameters of: 5 μm or smaller (% by number) | 3.17 μm or smaller (% by number) | Nr/Nv* | Particle diameters of 8 μm or larger (% by volume) | Quantity of triboelectricity of magnetic toner (μC/g) |
|---|---|---|---|---|---|---|---|
| Magnetic toner: | | | | | | | |
| 9 | 5.1 | 4.2 | 83 | 25 | 4.1 | 1 | −37 |
| 10 | 5.5 | 4.8 | 78 | 21 | 4.3 | 2 | −35 |
| 11 | 5.9 | 5.0 | 65 | 14 | 5.3 | 7 | −34 |
| 12 | 4.6 | 3.6 | 86 | 34 | 3.7 | 1 or less | −39 |
| 13 | 5.0 | 4.2 | 83 | 25 | 4.1 | 1 | −33 |
| 14 | 5.1 | 4.4 | 82 | 23 | 3.9 | 1 | −32 |
| 15 | 5.3 | 4.5 | 79 | 22 | 4.2 | 1 | −36 |
| 16 | 5.1 | 4.2 | 83 | 26 | 4.1 | 1 | −36 |
| 17 | 5.1 | 4.2 | 83 | 26 | 4.1 | 1 | −36 |
| 18** | 9.7 | 9.0 | 12 | 2 | 22 | 73 | −18 |

*Ratio of (% by number)/(% by volume) of magnetic toner particles with particle diameters of 3.17 μm or smaller
**Comparative Example

EXAMPLE 9

The magnetic toner 9 was used, and the apparatus as shown in FIG. 1 was used as an image forming apparatus.

As an electrostatic latent image bearing member, the same organic photoconductor (OPC) photosensitive drum as in Photosensitive Member Production Example 1 was used and was made to have a dark portion potential $V_D$ of −700 V and a light portion potential $V_L$ of −210 V. The photosensitive drum and a developing sleeve described below were so set as to leave a gap of 300 μm between them. A developing sleeve comprising an aluminum cylinder of 12 mm diameter with a mirror-finished surface and formed thereon a resin layer having the following composition and having a layer thickness of about 7 μm and a center-line average roughness (Ra) of 0.8 μm was used as a toner carrying member; development magnetic pole: 950 gausses. As a toner layer control member, a urethane rubber blade of 1.0 mm thick and 10 mm in free length was brought into touch with the surface of the developing sleeve at a linear pressure of 15 g/cm.

Resin layer composition:

| | |
|---|---|
| Phenol resin | 100 parts |
| Graphite (particle diameter: about 7 μm) | 90 parts |
| Carbon black | 10 parts |

Then, as development bias, DC bias component Vdc of −500 V and superimposing AC bias component Vpp of 1,200 V and f=2,000 Hz were applied. The developing sleeve was rotated at a peripheral speed of 150% (72 mm/sec) with respect to the peripheral speed of the photosensitive drum (48 mm/sec) and in the regular direction thereto (the opposite direction when viewed as the rotational direction).

A transfer roller as shown in FIG. 4 [made of ethylene-propylene rubber with conductive carbon dispersed therein; volume resistivity of the conductive resilient layer: $10^8$ Ω.cm; surface-rubber hardness: 24 degrees; diameter: 20 mm; contact pressure: 49 N/m (50 g/cm)] was set rotary at a speed equal to the peripheral speed of the photosensitive drum (48 mm/sec), and a transfer bias of +2,000 V was applied. As a toner, the magnetic toner 9 was used and images were reproduced in an environment of 23° C., 65% RH. As transfer paper, paper with a basis weight of 128 g/m$^2$ was used.

As a result, as shown in Table 7, good images were obtained, which were free from blank areas caused by poor transfer and had a sufficient image density and a high resolution. Also, 50 μm isolated-dot latent images showed resolution at a very good level. After further continuous printing on 5,000 sheets, there was seen no changes on the surface of the photosensitive drum, e.g., no melt-adhesion of toner.

In the present Example, black spots around line images are evaluated on minute fine lines concerned with the image quality of graphical images, and are evaluated on 100 μm line images, around which the black spots more tend to occur than black spots around lines of characters.

The resolution was evaluated by examining the reproducibility of small-diameter isolated dots as shown in FIG. 8, which tend to form closed electric fields on account of latent image electric fields and are difficult to reproduce.

A pattern of characters printed on A4-size paper in an area percentage of 4% was continuously printed out on 500 sheets from the initial stage, and toner consumption was determined from changes in the toner quantity in the developing assembly to find that it was 0.039 g/sheet. Also, on the photosensitive drum, 600 dpi 10-dot vertical line pattern latent images (line width: about 420 μm) were drawn at intervals of 1 cm by laser exposure, which were then developed, and the developed images were transferred onto an OHP sheet made of PET and fixed thereto. Vertical line pattern images thus formed were analyzed using a surface profile analyzer SURFCORDER SE-30H (manufactured by Kosaka Kenkyusho Co.). How the toner was laid on the vertical lines was observed as a profile of surface roughness, and their line width was determined from the width of this profile. As a result, the line width was 430 μm and the line images were reproduced at a high density and sharpness. Thus, it was confirmed that a low toner consumption was achieved while maintaining the latent image reproducibility.

Comparative Example 4

Using the magnetic toner 18, images were reproduced using the same apparatus and conditions as in Example 9 except that the organic photosensitive member of Photosensitive Member Production Example 2 was used as the electrostatic latent image bearing member. As a result, as shown in Table 7, images with conspicuous black spots around characters and with conspicuous blank areas caused by poor transfer (see FIG. 7B) were formed. As to the resolution of 50 μm isolated-dot latent images, images having an insufficient resolution and lacking in sharpness were obtained. After continuous printing on 5,000 sheets, there was seen melt-adhesion of toner on the surface of the photosensitive drum, which appeared as blank areas on the printed images.

EXAMPLES 10 TO 17

Using the magnetic toners 10 to 17, images were reproduced using the same apparatus and conditions as in Example 9. Results obtained are shown in Table 7.

EXAMPLE 18

Images were reproduced using the same apparatus and conditions as in Example 9 except that the organic photosensitive member of Photosensitive Member Production Example 1 was used as the electrostatic latent image bearing member. As a result, as shown in Table 7, good results were obtained. Also when an OHP sheet made of polyester was used as the transfer medium, good images free of blank areas caused by poor transfer were obtained.

EXAMPLE 19

Images were reproduced using the same apparatus and conditions as in Example 9 except that the organic photosensitive member of Photosensitive Member Production Example 2 was used as the electrostatic latent image bearing member. As a result, compared with Example 9, the blank areas caused by poor transfer a little occurred when paper of 128 g/m$^2$ was used as the transfer paper, which, however, were on the level not problematic in practical use. When paper of 75 g/m$^2$ was used as the transfer paper, no blank areas caused by poor transfer occurred, and very good results were obtained.

TABLE 7

| | * Image density | ** Black spots around line images | Blank areas caused by poor transfer | Resolution (isolated-/dot image) 100 μm | 50 μm | Magnetic toner consumption (g/sheet) | Melt-adhesion of toner on photo-sensitive member |
|---|---|---|---|---|---|---|---|
| Example: | | | | | | | |
| 9 | 1.46 | A | A | A | A | 0.039 | A |
| 10 | 1.45 | A | A | A | A | 0.038 | A |
| 11 | 1.46 | A | A | A | A | 0.040 | A |
| 12 | 1.42 | A | A | A | A | 0.035 | A |
| 13 | 1.41 | A | A | A | A | 0.031 | A |
| 14 | 1.41 | A | A | A | A | 0.038 | A |
| 15 | 1.43 | A | A | A | A | 0.037 | A |
| 16 | 1.43 | A | A | A | A | 0.036 | A |
| 17 | 1.44 | A | A | A | A | 0.038 | A |
| 18 | 1.47 | A | A | A | A | 0.038 | A |
| 19 | 1.46 | A | A–B | A | A | 0.039 | A |
| Comparative Example: | | | | | | | |
| 4 | 1.45 | C | C | C | C | 0.063 | C |

*of 5 mm × 5 mm solid black images
**around 100 μm wide horizontal lines

Magnetic Toner Production Example 19

| | |
|---|---|
| Magnetite (average particle diameter: 0.22 μm) | 100 parts |
| Styrene/n-butyl acrylate/n-butylmaleic half ester copolymer (copolymerization ratio: 77:20:3; Mw: 200,000) | 100 parts |
| Iron complex of monoazo dye (negative charge control agent) | 2 parts |
| Low-molecular weight polyolefin (release agent) | 3 parts |

The above materials were mixed using a blender, and then melt-kneaded using a twin-screw extruder heated to 140° C. The kneaded product obtained was cooled, and then crushed with a hammer mill. The crushed product was finely pulverized by means of a jet mill, and the finely pulverized product thus obtained was classified using an air classifier to obtain magnetic toner particles. To the magnetic toner particles thus obtained, 1.2% by weight of hydrophobic fine silica powder (treated with hexamethyldisilazane; BET specific surface area: 200 $m^2/g$) was added, which were then agitated and mixed by means of a Henschel mixer, followed by removal of coarse particles using a 150 mesh sieve to obtain magnetic toner A-2. The magnetic toner A-2 obtained had a weight average particle diameter of 5.0 μm. Physical properties of the magnetic toner are shown in Table 8.

Magnetic Toner Production Examples 20 to 25

Magnetic toner particles were obtained in the same manner as in Magnetic Toner Production Example 19 except that their particle diameter and particle size distribution were changed. To 100 parts of the magnetic toner particles obtained, 1.5 parts of hydrophobic fine silica powder (the same one as used in Magnetic Toner Production Example 19) was added, and the subsequent procedure of Magnetic Toner Production Example 19 was repeated to obtain magnetic toners B-2 to F-2. Physical properties of the magnetic toners B-2 to F-2 thus obtained are shown in Table 8.

Magnetic Toner Production Example 26

| | |
|---|---|
| Magnetite (average particle diameter: 0.22 μm) | 110 parts |
| Polyester resin | 100 parts |
| Iron complex of monoazo dye (negative charge control agent) | 2 parts |
| Low-molecular weight polyolefin (release agent) | 3 parts |

Magnetic toner particles were obtained in the same manner as in Magnetic Toner Production Example 19 except that the above materials were used. To the magnetic toner particles obtained, 1.0% by weight of hydrophobic fine silica powder (treated with dimethylsilicone oil; BET specific surface area: 130 $m^2/g$) was added, and the subsequent procedure of Magnetic Toner Production Example 19 was repeated to obtain magnetic toner G-2. Physical properties of the magnetic toner G-2 obtained are shown in Table 8.

Magnetic Toner Production Example 27

| | |
|---|---|
| Magnetite (average particle diameter: 0.18 μm) | 80 parts |
| Styrene/n-butyl acrylate copolymer (copolymerization ratio: 8:2; Mw: 260,000) | 100 parts |
| Chromium complex of monoazo dye (negative charge control agent) | 2 parts |
| Low-molecular weight ethylene/propylene copolymer | 3 parts |

Magnetic toner particles were obtained in the same manner as in Magnetic Toner Production Example 19 except that the above materials were used. To 100 parts of the magnetic toner particles obtained, 1.2 parts of hydrophobic fine silica powder (the same one as used in Magnetic Toner Production Example 19 ) was added, and the subsequent procedure of Magnetic Toner Production Example 19 was repeated to obtain magnetic toner H-2. Physical properties of the magnetic toner H-2 obtained are shown in Table 8.

TABLE 8

| | Weight average particle diameter (μm) | Volume average particle diameter (μm) | Magnetic toner particles with particle diameters of: 5 μm or smaller $M_r$ (% by number) | $M_v$ (% by volume) | $M_r/M_v$ | k | 3.17 μm or smaller $N_r$ (% by number) | $N_v$ (% by volume) | $N_r/N_v$ | 8 μm or larger (% by volume) |
|---|---|---|---|---|---|---|---|---|---|---|
| Magnetic toner: | | | | | | | | | | |
| A-2 | 5.1 | 4.3 | 77 | 52 | 1.48 | 5.33 | 19 | 4.2 | 4.52 | 1 |
| B-2 | 4.5 | 3.6 | 84 | 63 | 1.33 | 5.53 | 30 | 7.8 | 3.85 | 1 or less |
| C-2 | 5.3 | 4.5 | 75 | 47 | 1.60 | 5.35 | 20 | 4.2 | 4.76 | 2 |
| D-2 | 5.7 | 5.0 | 60 | 33 | 1.82 | 4.82 | 9 | 1.2 | 7.50 | 3 |
| E-2 | 5.8 | 5.0 | 66 | 34 | 1.94 | 5.24 | 12 | 2.1 | 5.71 | 8 |
| F-2* | 9.7 | 8.5 | 15 | 2 | 7.50 | 8.25 | 5 | 0.2 | 25.00 | 72 |
| G-2* | 12.0 | 10.3 | 11 | 0.4 | 27.50 | 28.05 | 4 | 0 | Inf. | 92 |
| H-2 | 5.2 | 4.5 | 73 | 46 | 1.59 | 5.24 | 16 | 3.3 | 4.85 | 1 or less |

*Comparative Example

EXAMPLE 20

The magnetic toner A-2 was used, and the apparatus as shown in FIG. 1 was used as an image forming apparatus.

As an electrostatic latent image bearing member, the same organic photoconductor (OPC) photosensitive drum as in Photosensitive Member Production Example 3 was used and was made to have a dark portion potential $V_D$ of −700 V and a light portion potential $V_L$ of −210 V. The photosensitive drum and a developing sleeve described below were so set as to leave a gap of 300 pm between them. A developing sleeve comprising an aluminum cylinder of 16 mm diameter with a mirror-finished surface and formed thereon a resin layer having the following composition and having a layer thickness of about 7 μm and a center-line average roughness (Ra) of 0.8 μm was used as a toner carrying member; development magnetic pole: 950 gausses. As a toner layer control member, a urethane rubber blade of 1.0 mm thick and 10 mm in free length was brought into touch with the surface of the developing sleeve at a linear pressure of 15 g/cm.

Resin layer composition:

| | |
|---|---|
| Phenol resin | 100 parts |
| Graphite (particle diameter: about 7 μm) | 90 parts |
| Carbon black | 10 parts |

Then, as development bias, DC bias component Vdc of −500 V and superimposing AC bias component Vpp of 1,200 V and f=2,000 Hz were applied. The developing sleeve was rotated at a peripheral speed of 150% (72 mm/sec) with respect to the peripheral speed of the photosensitive drum (48 mm/sec) and in the regular direction thereto.

A transfer roller as shown in FIG. 4 [made of ethylene-propylene rubber with conductive carbon dispersed therein; volume resistivity of the conductive resilient layer: $10^8$ Ω.cm; surface-rubber hardness: 24 degrees; diameter: 20 mm; contact pressure: 49 N/m (50 g/cm)] was set rotary at a speed equal to the peripheral speed of the photosensitive drum (48 mm/sec), and a transfer bias of +2,000 V was applied. As a toner, the magnetic toner A was used and images were reproduced in an environment of 23° C., 65% RH. As transfer paper, paper with a basis weight of 75 g/$m^2$ was used.

As a result, as shown in Table 9, good images were obtained, which were free from blank areas caused by poor transfer and had a sufficient image density and a high resolution. Also, 50 μm isolated-dot latent images showed resolution at a very good level.

In the present Example, black spots around line images are evaluated on minute fine lines concerned with the image quality of graphical images, and are evaluated on 100 μm line images, around which the black spots more tend to occur than black spots around lines of characters.

The resolution was evaluated by examining the reproducibility of small-diameter isolated dots as shown in FIG. 8, which tend to form closed electric fields on account of latent image electric fields and are difficult to reproduce.

To evaluate transfer performance, the toner remaining on the photosensitive member after transfer was taken off with Myler tape by putting the tape on and peeling it from its surface, and the tape with toner was stuck on white paper. From the Macbeth density measured thereon, the Macbeth density measured on tape alone (without toner) stuck on white paper was subtracted to obtain numerical values for evaluation. The results were very good.

A pattern of characters printed on A4-size paper in an area percentage of 4% was continuously printed out on 500 sheets from the initial stage, and toner consumption was determined from changes in the toner quantity in the developing assembly to find that it was 0.025 g/sheet. Also, on the photosensitive drum, 600 dpi 10-dot vertical line pattern latent images (line width: about 420 μm) were drawn at intervals of 1 cm by laser exposure, which were then developed, and the developed images were transferred onto an OHP sheet made of PET and fixed thereto. Vertical line pattern images thus formed were analyzed using a surface profile analyzer SURFCORDER SE-30H (manufactured by Kosaka Kenkyusho Co.). How the toner was laid on the vertical lines was observed as a profile of surface roughness, and their line width was determined from the width of this profile. As a result, the line width was 430 μm and the line images were reproduced at a high density and sharpness. Thus, it was confirmed that a low toner consumption was achieved while maintaining the latent image reproducibility.

Images were further reproduced continuously up to 6,000 sheets, and the wear of the photosensitive member surface was measured using a coating thickness tester. As a result, the wear was as very small as 0 to 1 μm.

EXAMPLES 21 TO 25

Using the magnetic toners B-2 to E-2, images were reproduced using the same apparatus and conditions as in Example 20. Results obtained are shown in Table 9.

EXAMPLE 26

Images were reproduced using the same apparatus and conditions as in Example 20 except that the magnetic toner H-2 was used and the photosensitive member of Photosensitive Member Production Example 1 was used as the electrostatic latent image bearing member. Results obtained are shown in Table 9.

Comparative Examples 5 and 6

Using the magnetic toners F-2 and G-2, images were reproduced using the same apparatus and conditions as in Example 19 except that the photosensitive member of Photosensitive Member Production Example 2 was used as the electrostatic latent image bearing member. As a result, images with conspicuous blank areas caused by poor transfer and conspicuous black spots around line images were formed. As to the resolution of 100 μm isolated-dot latent images, images having an insufficient resolution were obtained. The toner consumption was also great as shown in Table 9. The wear of the photosensitive member was also as great as 3 to 5 μm.

Magnetic Toner Production Example 28

| | |
|---|---|
| Magnetic material (saturation magnetization σs under 79.6 kA/m: 63 $Am^2/kg$; silicon element content: 1.7%; average particle diameter: 0.22 μm; BET specific surface area: 22 $m^2/g$; sphericity: 0.90) | 100 parts |
| Styrene/n-butyl acrylate/n-butylmaleic half ester copolymer | 100 parts |
| Iron complex of monoazo dye (negative charge control agent) | 2 parts |
| Low-molecular weight polyolefin (release agent) | 7 parts |

The above materials were mixed using a blender, and then melt-kneaded using a twin-screw extruder heated to 130° C. The kneaded product obtained was cooled, and then crushed with a hammer mill. The crushed product was finely pulverized by means of a jet mill, and the finely pulverized product thus obtained was strictly classified using a multi-division classifier utilizing the Coanda effect, to obtain magnetic toner particles. To the magnetic toner particles thus obtained, 1.5% by weight of dry-process silica treated with silicone oil and hexamethyldisilazane (BET specific surface area: 200 $m^2/g$) was added, which were then mixed by means of a Henschel mixer to obtain magnetic toner A-3. The magnetic toner A-3 obtained had a weight average particle diameter ($D_4$) of 5.5 μm, a volume average particle diameter ($D_v$) of 4.8 μm, $M_r$ of 68% by number, $M_v$ of 2.1% by volume, and $N_r/N_v$ of 5.5. Physical properties of the magnetic toner are summarized in Table 10.

TABLE 9

| | * Image density | ** Black spots around line images | Blank areas caused by poor transfer | Resolution (isolated dot image) 100 μm | 50 μm | Magnetic toner consumption (g/sheet) | Transfer performance (Rank) | *** Wear of photo-sensitive member (μm) |
|---|---|---|---|---|---|---|---|---|
| Example: | | | | | | | | |
| 20 | 1.45 | A | A | A | A | 0.036 | 1 | 0–1 |
| 21 | 1.4 | A | A | A | A | 0.034 | 2 | 0–1 |
| 22 | 1.42 | A | A | A | A | 0.037 | 1 | 0–1 |
| 23 | 1.43 | A | A | A | A | 0.038 | 1 | 0–1 |
| 24 | 1.45 | A | A | A | A | 0.040 | 1 | 0–1 |
| 25 | 1.48 | A | A | A | A–B | 0.042 | 1 | 0–1 |
| 26 | 1.44 | A | A–B | A | A | 0.038 | 2 | 1–3 |
| Comparative Example: | | | | | | | | |
| 5 | 1.49 | C | B | B | C | 0.064 | 3 | 3–5 |
| 6 | 1.5 | C | B | C | C | 0.070 | 3 | 3–5 |

*of 5 mm × 5 mm solid black images
**around 100 μm wide horizontal lines
***upon 6,000 sheet printing 1) Blank areas caused by poor transfer:

A: Not occur (Very good)

B: A little seen but tolerable in practical use.

C: Blank areas caused by poor transfer are conspicuous and not tolerable in practical use.

2) Transfer performance:

Evaluated according to four ranks on how much toner remained after transfer. The density (degree of opacity) of tape with toner taken off from the photosensitive member surface (the density subtracted from the tape density) is;

rank 1: less than 0.1.

rank 2: 0.1 to less than 0.13.

rank 3: 0.13 to less than 0.16.

rank 4: not less than 0.16.

Magnetic Toner Production Examples 29 and 30

The same crushed product as the one obtained in Magnetic Toner Production Example 28 was subjected to the steps of pulverization and classification under different control to obtain magnetic toner particles with different particle diameter and particle size distribution. To the magnetic toner particles obtained, 1.3% by weight of the same treated dry-process silica as used in Magnetic Toner Production Example 28 was added, followed by mixing by means of a mixing machine to obtain magnetic toners B-3 and C-3. Physical properties of the magnetic toners B-3 and C-3 thus obtained are shown in Table 10.

Magnetic Toner Production Example 31

Magnetic toner D-3 was obtained in the same manner as in Magnetic Toner Production Example 28 except that 1.8% by weight of dry-process silica treated with silicone oil and hexamethyldisilazane (BET specific surface area: 300 $m^2/g$) was used as the inorganic fine powder. Physical properties of the magnetic toner D-3 obtained are shown in Table 10.

Magnetic Toner Production Example 32

| | |
|---|---|
| Magnetic material (saturation magnetization σs under 79.6 kA/m: 60 $Am^2/kg$; silicon element content: 3.1%; average particle diameter: 0.24 μm; BET specific surface area: 26 $m^2/g$; sphericity: 0.87) | 90 parts |
| Polyester resin | 100 parts |
| Iron complex of monoazo dye (negative charge control agent) | 2 parts |
| Low-molecular weight polyolefin (release agent) | 4 parts |

Magnetic toner E-3 was obtained in the same manner as in Magnetic Toner Production Example 31 except that the above materials were used. Physical properties of the magnetic toner E-3 obtained are shown in Table 10.

Magnetic Toner Production Example 33

Magnetic toner F-3 was obtained in the same manner as in Magnetic Toner Production Example 28 except that 1.7% by weight of dry-process silica treated with silicone oil and hexamethyldisilazane (BET specific surface area: 200 $m^2/g$) and 0.5% by weight of titania treated with silicone oil (BET specific surface area: 50 $m^2/g$) were mixed and added to be used as the inorganic fine powder. Physical properties of the magnetic toner F-3 obtained are shown in Table 10.

Magnetic Toner Production Example 34

Magnetic toner G-3 was obtained in the same manner as in Magnetic Toner Production Example 28 except that 0.3% by weight of alumina treated with silicone oil (BET specific surface area: 100 $m^2/g$) and 1.2% by weight of dry-process silica treated with silicone oil and hexamethyldisilazane (BET specific surface area: 200 $m^2/g$) were mixed and added to be used as the inorganic fine powder. Physical properties of the magnetic toner G-3 obtained are shown in Table 10.

Magnetic Toner Production Example 35

Magnetic toner H-3 was obtained in the same manner as in Magnetic Toner Production Example 28 except that the magnetic material was replaced with a magnetic material having a saturation magnetization σs under 79.6 kA/m, of 65 $Am^2/kg$, a silicon element content of 0.3%, an average particle diameter of 0.19 μm, a BET specific surface area of 8 $m^2/g$, a sphericity of 0.78. Physical properties of the magnetic toner H-3 obtained are shown in Table 10.

Magnetic Toner Production Example 36

Magnetic toner I-3 was obtained in the same manner as in Magnetic Toner Production Example 28 except that the silica was replaced with silica treated with dimethyldichlorosilane (BET specific surface area: 130 $m^2/g$) and added in an amount of 1.2% by weight. Physical properties of the magnetic toner I-3 obtained are shown in Table 10.

Magnetic Toner Production Comparative Examples 5 and 6

The same crushed product as the one obtained in Magnetic Toner Production Example 28 was subjected to the steps of pulverization and classification under different control to obtain magnetic toner particles with different particle diameter and particle size distribution. To the magnetic toner particles obtained, 1.3% by weight of dry-process silica treated with hexamethyldisilazane (BET specific surface area: 200 $m^2/g$) was added, followed by mixing by means of a mixing machine to obtain magnetic toners J-3 and K-3. Physical properties of the magnetic toners J-3 and K-3 thus obtained are shown in Table 10.

TABLE 10

| | Average particle diameter | | Magnetic toner particles with particle diameters of: 5 μm or smaller | 8 μm or larger | 3.17 μm or smaller | | |
|---|---|---|---|---|---|---|---|
| | $D_4$ (μm) | $D_v$ (μm) | $M_r$ (% by number) | $M_v$ (% by volume) | $N_r$ (% by number) | $N_v$ (% by volume) | $N_r/N_v$ |
| Magnetic toner: | | | | | | | |
| A-3 | 5.5 | 4.8 | 68 | 2.1 | 17.7 | 3.2 | 5.5 |
| B-3 | 5.3 | 4.4 | 81 | 4.5 | 28.6 | 6.9 | 4.1 |
| C-3 | 5.7 | 5.1 | 60 | 2.5 | 9.1 | 1.2 | 7.6 |
| D-3 | 4.9 | 4.3 | 82 | 0.5 | 23.9 | 5.7 | 4.2 |
| E-3 | 5.8 | 4.9 | 68 | 7.3 | 12.8 | 2.3 | 5.6 |
| F-3 | 5.5 | 4.8 | 68 | 2.1 | 18 | 3.2 | 5.6 |
| G-3 | 5.5 | 4.8 | 68 | 2.2 | 17.8 | 3.2 | 5.6 |
| H-3 | 5.5 | 4.8 | 68 | 2.2 | 17.7 | 3.2 | 5.5 |
| I-3 | 5.5 | 4.8 | 68 | 2.2 | 18 | 3.2 | 5.6 |
| J-3* | 6.9 | 6 | 37 | 22.4 | 6.1 | 0.4 | 15.3 |
| K-3* | 6.1 | 5.4 | 49 | 6.2 | 7.2 | 0.8 | 9 |

*Comparative Example

Developing Sleeve Production Example 1

| | |
|---|---|
| Resol type phenol resin solution (containing 50% by weight of methanol) | 200 parts |
| Graphite (number average particle diameter: 9 μm) | 50 parts |
| Conductive carbon black | 5 parts |
| Isopropyl alcohol | 130 parts |

To the above materials, zirconia beads of 1 mm diameter were added as media particles, and the mixture was dispersed by means of a sand mill for 2 hours, and then the beads were separated using a sieve to obtain a material solution. Subsequently, to 380 parts of this material solution, 10 parts of spherical PMMA particles (number average particle diameter: 12 μm) and isopropyl alcohol was further added so as for the solid matter to be in a concentration of 30%, followed by dispersion using glass beads of 3 mm diameter, and then the beads were separated using a sieve to obtain a coating solution.

Using this coating solution, a coat layer was formed on an aluminum cylinder of 16 mm outer diameter by spraying, followed by heating at 150° C. for 30 minutes in a hot-air drying furnace to effect curing. Thus, developing sleeve 1 was produced. The value of Ra of the developing sleeve 1 obtained was 1.9 μm.

Developing Sleeve Production Example 2

Developing sleeve 2 was obtained in the same manner as in Developing Sleeve Production Example 1 except that the spherical particles were replaced with 15 parts of spherical PMMA particles (number average particle diameter: 6 μm). The value of Ra of the developing sleeve 2 obtained was 1.4 μm.

Developing Sleeve Production Example 3

Developing sleeve 3 was obtained in the same manner as in Developing Sleeve Production Example 1 except that 10 parts of the spherical PMMA particles were replaced with 10 parts of spherical nylon resin particles (number average particle diameter: 9 μm). The value of Ra of the developing sleeve 3 obtained was 2.2 μm.

Developing Sleeve Production Example 4

Developing sleeve 4 was obtained in the same manner as in Developing Sleeve Production Example 1 except that 10 parts of the spherical PMMA particles were replaced with 20 parts of spherical phenol resin particles (number average particle diameter: 20 μm). The value of Ra of the developing sleeve 4 obtained was 2.7 μm.

Developing Sleeve Production Example 5

Developing sleeve 5 was obtained in the same manner as in Developing Sleeve Production Example 1 except that 10 parts of the spherical PMMA particles were replaced with 15 parts of spherical styrene-diaminoethyl methacrylate-divinylbenzene copolymer particles (copolymerization ratio: 90:10:0.1; number average particle diameter: 20 μm). The value of Ra of the developing sleeve 5 obtained was 2.1 μm.

Developing Sleeve Production Example 6

| | |
|---|---|
| Resol type phenol resin solution (containing 50% by weight of methanol) | 200 parts |
| Graphite (number average particle diameter: 1.5 μm) | 30 parts |
| Conductive carbon black | 5 parts |
| Isopropyl alcohol | 130 parts |

To the above materials, zirconia beads of 1 mm diameter were added as media particles, and the mixture was dispersed by means of a sand mill for 2 hours, and then the beads were separated using a sieve to obtain a material solution. Subsequent procedure of Developing Sleeve Production Example 1 was repeated except that 10 parts of spherical PMMA particles (number average particle diameter: 17 μm) were added to 380 parts of this material solution. Thus, developing sleeve 6 was produced. The value of Ra of the developing sleeve 6 obtained was 2.4 μm.

EXAMPLE 27

A modified machine of LBP-8 Mark IV was used as an evaluation machine, a rubber roller (diameter: 12 mm; contact pressure: 50 g/cm) coated with nylon resin with conductive carbon dispersed therein was used as a primary charging roller, and a dark portion potential $V_D$ of −700 V and a light portion potential $V_L$ of −200 V were formed on its electrostatic latent image bearing member (a photosensitive drum) by laser exposure (600 dpi). The developing sleeve 1 of Developing Sleeve Production Example 1 was used as a toner carrying member, and the photosensitive drum and the developing sleeve were so set as to leave a gap (S-D distance) of 300 μm between them; development magnetic pole: 800 gausses. As a toner layer control member, a urethane rubber blade of 1.0 mm thick and 10 mm in free length was brought into touch with the surface of the developing sleeve at a linear pressure of 15 g/cm. As development bias, DC bias component Vdc of −500 V and superimposing AC bias component Vpp of 1,600 V and frequency 2,200 Hz were applied.

Using the magnetic toner A-3, images were reproduced continuously on 5,000 sheets in an environment of temperature 15° C. and humidity 10% RH. As a result, as shown in Table 11, good images were obtained, which retained a sufficient solid image density and were free from ghost, black spots around line images and blank areas caused by poor transfer.

In an environment of temperature 23° C. and humidity 65% RH, a pattern of characters printed on A4-size paper (75 g/m$^2$) in an area percentage of 4% was continuously printed out on 500 sheets from the initial stage, and toner consumption was determined from changes in the toner quantity in the developing assembly to find that it was 0.032 g/sheet. Also, on the photosensitive drum, 600 dpi 10-dot horizontal line pattern latent images (line width: about 420 μm) were drawn at intervals of 1 cm by laser exposure, which were then developed, and the developed images were transferred onto an OHP sheet made of PET and fixed thereto. Horizontal line pattern images thus formed were analyzed using a surface profile analyzer SURFCORDER SE-30H (manufactured by Kosaka Kenkyusho Co.). How the toner was laid on the horizontal lines was observed as a profile of surface roughness, and their line width was determined from the width of this profile. As a result, the line width was 430 μm and the line images were reproduced at a high density and sharpness. Thus, it was confirmed that a low toner consumption was achieved while maintaining the latent image reproducibility.

In the present Example, black spots around line images are evaluated on minute fine lines concerned with the image quality of graphical images, and are evaluated on 100 μm line images, around which the black spots more tend to occur than black spots around lines of characters.

The resolution was evaluated by examining the reproducibility of small-diameter isolated dots (50 μm) as shown in FIG. 8, which tend to form closed electric fields on account of latent image electric fields and are difficult to reproduce.

The evaluation on the blank areas caused by poor transfer is evaluation made when images are printed on cardboad (about 128 g/m$^2$) which tends to cause blank areas caused by poor transfer.

To make evaluation on ghost, halftone images were developed when a position on the developing sleeve at which an image having a solid white area and a solid black area adjoining to each other was developed within the range where the leading edge of printed images goes around the sleeve once came to the development position at the next rotation of the developing sleeve. In that state, differences in light and shade appearing on the halftone images (the effect of development history during one rotation of the developing sleeve) were visually evaluated.

Comparative Example 7

Images were reproduced in the same manner as in Example 27 except that the toner and the developing sleeve were replaced with the magnetic toner J-3 and the developing sleeve 7, respectively. As a result, the results as shown in Table 11 were obtained, where toner consumption was greater than that in Example 27 and images with a little many black spots around line images and blank areas caused by poor transfer and a little poor resolution were formed.

Comparative Example 8

Images were reproduced in the same manner as in Example 27 except that the developing sleeve was replaced with the developing sleeve 8 and the magnetic toner K-3 was used. As a result, the results as shown in Table 11 were obtained, where unsharp images with a low image density were formed.

EXAMPLE 28

Images were reproduced using the same apparatus and conditions as in Example 27 except that the toner and the developing sleeve were replaced with the magnetic toner B-3 and the developing sleeve 2, respectively. As a result, as shown in Table 11, good images and toner consumption were obtained.

EXAMPLE 29

Images were reproduced using the same apparatus and conditions as in Example 27 except that the toner and the developing sleeve were replaced with the magnetic toner C-3 and the developing sleeve 3, respectively. As a result, good images and toner consumption were obtained. The results are shown in Table 11.

EXAMPLE 30

Images were reproduced using the same apparatus and conditions as in Example 27 except that the toner and the developing sleeve were replaced with the magnetic toner D-3 and the developing sleeve 4, respectively. As a result, good images and toner consumption were obtained. The results are shown in Table 11.

EXAMPLE 31

Images were reproduced using the same apparatus and conditions as in Example 27 except that the toner and the developing sleeve were replaced with the magnetic toner E-3 and the developing sleeve 5, respectively. As a result, good images and toner consumption were obtained. The results are shown in Table 11.

EXAMPLE 32

Images were reproduced using the same apparatus and conditions as in Example 27 except that the toner and the developing sleeve were replaced with the magnetic toner F-3 and the developing sleeve 6, respectively. As a result, good images and toner consumption were obtained. The results are shown in Table 11.

EXAMPLE 33

Images were reproduced using the same apparatus and conditions as in Example 27 except that the magnetic toner G-3 was used. As a result, although the resolution slightly lowered, good toner consumption was obtained. The results are shown in Table 11.

EXAMPLES 34 AND 35

Images were reproduced using the same apparatus and conditions as in Example 27 except that the toner was replaced with the magnetic toners H-3 and I-3. As a result, although blank areas caused by poor transfer were slightly seen in the case of the magnetic toner I-3, good images were obtained. The results are shown in Table 11.

TABLE 11

| | In environment of 15° C., 10% RH, after 5,000 sh. printing | | | | | Measured in environment of 23° C., 65% RH | |
|---|---|---|---|---|---|---|---|
| | Solid black image density | Black spots around line images | Resolution | Ghost | Blank areas caused by poor transfer | Toner consumption (g/sheet) | 10 dot line width |
| Example: | | | | | | | |
| 27 | 1.49 | A | A | A | A | 0.032 | 430 |
| 28 | 1.48 | A | A | A | A | 0.033 | 430 |
| 29 | 1.5 | A | A | A | A | 0.035 | 440 |
| 30 | 1.47 | A | A | A | A | 0.033 | 420 |
| 31 | 1.5 | A | A | A | A | 0.037 | 430 |
| 32 | 1.47 | A | A | A | A | 0.032 | 410 |
| 33 | 1.43 | A | A | A | A | 0.031 | 390 |
| 34 | 1.48 | A | A | A | A | 0.036 | 430 |
| 35 | 1.47 | A | A | A | B–C | 0.036 | 430 |

TABLE 11-continued

| | In environment of 15° C., 10% RH, after 5,000 sh. printing | | | | | Measured in environment of 23° C., 65% RH | |
|---|---|---|---|---|---|---|---|
| | Solid black image density | Black spots around line images | Resolution | Ghost | Blank areas caused by poor transfer | Toner consumption (g/sheet) | 10 dot line width |
| Comparative Example: | | | | | | | |
| 7 | 1.5 | B–C | B–C | B | B | 0.048 | 460 |
| 8 | 0.35 | C | C | C | B–C | 0.055 | 440 |

In the evaluation on black spots around line images;

A: Very good (no black spot at all).

B: Good (a little seen, but no problem in practical use).

C: Black spots are conspicuous.

In the evalution of resolution;

A: Very good.

B: Good.

C: Poor resolution.

In the evalution on blank areas caused by poor transfer;

A: Very good (no blank area at all).

B: Good (a little seen, but no problem in practical use).

C: Blank areas are conspicuous.

In the evalution on ghost;

A: Very good (no difference in light and shade at all).

B: Good (differences in light and shade are slightly seen, but no problem in practical use).

C: Differences in light and shade are seen.

What is claimed is:

1. A magnetic toner comprising magnetic toner particles containing a binder resin and a magnetic material, and an inorganic fine powder treated with an organic compound, wherein said magnetic toner has:

a volume average particle diameter $D_v$ (μm) of 3 μm$\leqq D_v<6$ μm;

a weight average particle diameter $D_4$ (μm) of 3.5 μm$\leqq D_4<6.5$ μm;

a percentage $M_r$ of particles with particle diameters of 5 μm or smaller in number particle size distribution of the magnetic toner, of 60% by number$<M_r\leqq 90\%$ by number; and a ratio of a percentage $N_r$ of particles with particle diameters of 3.17 μm or smaller in number particle size distribution of the magnetic toner to a percentage $N_v$ of particles with particle diameters of 3.17 μm or smaller in volume particle size distribution of the magnetic toner, $N_r/N_v$, of from 2.0 to 8.0.

2. The magnetic toner according to claim 1, wherein the ratio of a percentage $N_r$ of particles with particle diameters of 3.17 μm or smaller in number particle size distribution of the magnetic toner to a percentage $N_v$ of particles with particle diameters of 3.17 μm or smaller in volume particle size distribution of the magnetic toner, $N_r/N_v$, is from 3.0 to 7.0.

3. The magnetic toner according to claim 1, wherein said magnetic toner has a volume percentage of particles with particle diameters of 8 μm or larger in volume particle size distribution, of not more than 10% by volume.

4. The magnetic toner according to claim 1, wherein said inorganic fine powder treated with an organic compound is a fine powder of a material selected from the group consisting of titania, alumina, silica and a composite of any of these.

5. The magnetic toner according to claim 1, wherein said magnetic toner has an absolute value Q (mC/g) of quantity of triboelectricity with respect to iron powder, of $14\leqq Q\leqq 80$ mC/kg.

6. The magnetic toner according to claim 5, wherein said magnetic toner has an absolute value Q (mC/g) of quantity of triboelectricity with respect to iron powder, of $14\leqq Q\leqq 60$ mC/kg.

7. The magnetic toner according to claim 6, wherein said magnetic toner has an absolute value Q (mC/g) of quantity of triboelectricity with respect to iron powder, of $24<Q\leqq 55$ mC/kg.

8. The magnetic toner according to claim 1, wherein said inorganic fine powder is treated on its particle surfaces, with an silicone oil or a silicone varnish.

9. The magnetic toner according to claim 1, wherein said magnetic material is formed of a metal oxide having a magnetization intensity of greater than 50 $Am^2/kg$ (emu/g) under application of a magnetic field of 79.6 kA/m (1,000 oersteds).

10. The magnetic toner according to claim 1, wherein said magnetic toner particles contain a liquid lubricant inside the particles.

11. The magnetic toner according to claim 10, wherein said liquid lubricant is supported on the magnetic material.

12. The magnetic toner according to claim 10, wherein said liquid lubricant is supported on particles to form lubricating particles.

13. The magnetic toner according to claim 12, wherein said lubricating particles are formed of from 20 parts by weight to 90 parts by weight of the liquid lubricant and from 80 parts by weight to 10 parts by weight of the particles.

14. The magnetic toner according to claim 10, wherein said liquid lubricant has a viscosity at 25° C., of from 10 cSt to 200,000 cSt.

15. The magnetic toner according to claim 1, which further contains lubricating particles supporting a liquid lubricant.

16. The magnetic toner according to claim 15, wherein said lubricating particles have from 20 parts by weight to 90 parts by weight of the liquid lubricant.

17. The magnetic toner according to claim 15, wherein said liquid lubricant has a viscosity at 25° C., of from 10 cSt to 200,000 cSt.

18. The magnetic toner according to claim 15, wherein said lubricating particles are formed of the liquid lubricant and fine inorganic compound particles.

19. The magnetic toner according to claim 15, wherein said lubricating particles are formed of the liquid lubricant and fine organic compound particles.

20. The magnetic toner according to claim 18, wherein said lubricating particles are formed of from 20 parts by weight to 90 parts by weight of the liquid lubricant and from 80 parts by weight to 10 parts by weight of the fine inorganic compound particles.

21. The magnetic toner according to claim 20, wherein said liquid lubricant is a silicone oil, and said fine inorganic compound particles are fine silica particles.

22. The magnetic toner according to claim 1, wherein said magnetic material has a sphericity $\phi$ of 0.8 or more and has a silicon element content of from 0.5% by weight to 4% by weight based on iron element.

23. The magnetic toner according to claim 1, wherein the percentage $M_r$ of said magnetic toner is from 62% by number to 88% by number.

24. An image forming method comprising:

electrostatically charging an electrostatic latent image bearing member through a charging means;

exposing the charged electrostatic latent image bearing member to light to form an electrostatic latent image on the electrostatic latent image bearing member;

developing the electrostatic latent image through a developing means having a magnetic toner, to form a magnetic toner image on the electrostatic latent image bearing member;

transferring the magnetic toner image to a transfer medium via, or not via, an intermediate transfer medium through a transfer means to which a bias voltage is applied, wherein said magnetic toner comprises magnetic toner particles containing a binder resin and a magnetic material, and an inorganic fine powder treated with an organic compound, wherein said magnetic toner has;

a volume average particle diameter $D_v$ (μm) of 3 μm$\leqq D_v<6$ μm;

a weight average particle diameter $D_4$ (μm) of 3.5 μm$\leqq D_4<6.5$ μm;

a percentage $M_r$ of particles with particle diameters of 5 μm or smaller in number particle size distribution of the magnetic toner, of 60% by number$<M_r\leqq 90\%$ by number; and a ratio of a percentage $N_r$ or particles with particle diameters of 3.17 μm or smaller in number particle size distribution of the magnetic toner to a percentage $N_v$ of particles with particle diameters of 3.17 μm or smaller in volume particle size distribution of the magnetic toner, $N_r/N_v$, of from 2.0 to 8.0.

25. The image forming method according to claim 24, wherein said charging means comes into contact with the surface of the electrostatic latent image bearing member.

26. The image forming method according to claim 24, wherein said transfer means is so provided as to come into pressure contact with the surface of the electrostatic latent image bearing member.

27. The image forming method according to claim 24, wherein said electrostatic latent image bearing member is cleaned through a cleaning means after the magnetic toner image has been transferred to the transfer medium.

28. The image forming method according to claim 24, wherein said developing means has a toner carrying member and a toner layer thickness control member, and an alternating electric field is applied to the toner carrying member.

29. The image forming method according to claim 24, wherein said toner carrying member is covered on its surface with a resin layer containing conductive fine particles.

30. The image forming method according to claim 24, wherein said toner carrying member is internally provided with a magnetic field generating means.

31. The image forming method according to claim 24, wherein said electrostatic latent image bearing member is an organic photoconductor photosensitive member.

32. The image forming method according to claim 24, wherein said electrostatic latent image bearing member has the surface with a contact angle to water of not smaller than 85 degrees.

33. The image forming method according to claim 31, wherein said electrostatic latent image bearing member has the surface with a contact angle to water of not smaller than 90 degrees.

34. The image forming method according to claim 29, wherein said resin layer of the toner carrying member further has particles for forming irregularities on its surface.

35. The image forming method according to claim 24, wherein said electrostatic latent image bearing member has on its surface a layer containing fluorine.

36. The image forming method according to claim 24, wherein the ratio of a percentage $N_r$ of particles with particle diameters of 3.17 μm or smaller in number particle size distribution of the magnetic toner to a percentage $N_v$ of particles with particle diameters of 3.17 μm or smaller in volume particle size distribution of the magnetic toner, $N_r/N_v$, is from 3.0 to 7.0.

37. The image forming method according to claim 24, wherein said magnetic toner has a volume percentage of particles with particle diameters of 8 μm or larger in volume particle size distribution, of not more than 10% by volume.

38. The image forming method according to claim 24, wherein said inorganic fine powder treated with an organic compound is a fine powder of a material selected from the group consisting of titania, alumina, silica and a composite of any of these.

39. The image forming method according to claim 24, wherein said magnetic toner has an absolute value Q (mC/g) of quantity of triboelectricity with respect to iron powder, of $14\leqq Q\leqq 80$ mC/kg.

40. The image forming method according to claim 39, wherein said magnetic toner has an absolute value Q (mC/g) of quantity of triboelectricity with respect to iron powder, of $14\leqq Q\leqq 60$ mC/kg.

41. The image forming method according to claim 40, wherein said magnetic toner has an absolute value Q (mC/g) of quantity of triboelectricity with respect to iron powder, of $24<Q\leqq 55$ mC/kg.

42. The image forming method according to claim 24, wherein said inorganic fine powder is treated on its particle surfaces, with an silicone oil or a silicone varnish.

43. The image forming method according to claim 24, wherein said magnetic material is formed of a metal oxide having a magnetization intensity of greater than 50 $Am^2/kg$ (emu/g) under application of a magnetic field of 79.6 kA/m (1,000 oersteds).

44. The image forming method according to claim 24, wherein said magnetic toner particles contain a liquid lubricant inside the particles.

45. The image forming method according to claim 44, wherein said liquid lubricant is supported on the magnetic material.

46. The image forming method according to claim 44, wherein said liquid lubricant is supported on particles to form lubricating particles.

47. The image forming method according to claim 46, wherein said lubricating particles are formed of from 20 parts by weight to 90 parts by weight of the liquid lubricant and from 80 parts by weight to 10 parts by weight of the particles.

48. The image forming method according to claim 44, wherein said liquid lubricant has a viscosity at 25° C., of from 10 cSt to 200,000 cSt.

49. The image forming method according to claim 24, wherein said magnetic toner further contains lubricating particles supporting a liquid lubricant.

50. The image forming method according to claim 49, wherein said lubricating particles have from 20 parts by weight to 90 parts by weight of the liquid lubricant.

51. The image forming method according to claim 49, wherein said liquid lubricant has a viscosity at 25° C., of from 10 cSt to 200,000 cSt.

52. The image forming method according to claim 49, wherein said lubricating particles are formed of the liquid lubricant and fine inorganic compound particles.

53. The image forming method according to claim 49, wherein said lubricating particles are formed of the liquid lubricant and fine organic compound particles.

54. The image forming method according to claim 52, wherein said lubricating particles are formed of from 20 parts by weight to 90 parts by weight of the liquid lubricant and from 80 parts by weight to 10 parts by weight of the fine inorganic compound particles.

55. The image forming method according to claim 54, wherein said liquid lubricant is a silicone oil, and said fine inorganic compound particles are fine silica particles.

56. The image forming method according to claim 24, wherein said magnetic material has a sphericity $\phi$ of 0.8 or more and has a silicon element content of from 0.5% by weight to 4% by weight based on iron element.

57. The image forming method according to claim 24, wherein the percentage $M_r$ of said magnetic toner is from 62% by number to 88% by number.

* * * * *

UNITED STATES PATENT AND TRADEMARK OFFICE

CERTIFICATE OF CORRECTION

PATENT NO. : 5,618,647

DATED : April 8, 1997

INVENTOR(S) : TSUTOMU KUKIMOTO, ET AL.

It is certified that error appears in the above-indentified patent and that said Letters Patent is hereby corrected as shown below:

ON THE COVER SHEET:

FOREIGN PATENT DOCUMENTS

"54-58245 2/1991" should read
--54-58245 5/1979--.

COLUMN 6:

Line 21, "It" should read --If--.
Line 44, "tends" should read --tend--.

COLUMN 7:

Line 39, "It" should read --If--.

COLUMN 8:

Line 39, "however," should read --however, is--.

COLUMN 9:

Line 5, "caster" should read --castor--.

UNITED STATES PATENT AND TRADEMARK OFFICE

CERTIFICATE OF CORRECTION

PATENT NO. : 5,618,647

DATED : April 8, 1997

INVENTOR(S) : TSUTOMU KUKIMOTO, ET AL.

It is certified that error appears in the above-indentified patent and that said Letters Patent is hereby corrected as shown below:

COLUMN 11:

Line 18, "used" should read --use--.

COLUMN 14:

Line 21, "ceed" should read --ced--.

COLUMN 16:

Line 23, "tIf" should read --If--.

COLUMN 17:

Line 13, "assists" should read --assist--.

COLUMN 18:

Line 15, "little occur" should read --less likely to occur--.
Line 31, delete "little".
Line 32, "occur," should read --less likely to occur--.

UNITED STATES PATENT AND TRADEMARK OFFICE

CERTIFICATE OF CORRECTION

PATENT NO. : 5,618,647

DATED : April 8, 1997

INVENTOR(S) : TSUTOMU KUKIMOTO, ET AL.

It is certified that error appears in the above-indentified patent and that said Letters Patent is hereby corrected as shown below:

COLUMN 19:

Line 15, "more tends" should read --tends more--.

COLUMN 21:

Line 58, "see also" should read --seen also with--.

COLUMN 33:

Line 42, "produced" should read --produce--.
Line 54, "spray coated" should read --spray-coated--.

COLUMN 38:

Line 57, "little occurred" should read --less likely to occur--.

COLUMN 42:

Line 29, "more tend" should read --tends more--.

COLUMN 43:

Line 62, "is;" should read --is:--.

UNITED STATES PATENT AND TRADEMARK OFFICE

CERTIFICATE OF CORRECTION

PATENT NO. : 5,618,647 Page 4 of 4

DATED : April 8, 1997

INVENTOR(S) : TSUTOMU KUKIMOTO, ET AL.

It is certified that error appears in the above-indentified patent and that said Letters Patent is hereby corrected as shown below:

COLUMN 49:

Line 20, "little" should read --many--.
Line 21, "many" should read --little--.

COLUMN 51:

Line 15, "images;" should read --images:--.
Line 20, "resolution;" should read --resolution:--, and "evalution" should read --evaluation--.
Line 24, "transfer;" should read --transfer:--, and "evalution" should read --evaluation--.
Line 28, "ghost;" should read --ghost:--, and "evalution" should read --evaluation--.

Signed and Sealed this

Seventeenth Day of February, 1998

*Attest:*

Bruce Lehman

BRUCE LEHMAN

*Attesting Officer*

*Commissioner of Patents and Trademarks*